US010336106B2

(12) United States Patent
Tokunaga et al.

(10) Patent No.: US 10,336,106 B2
(45) Date of Patent: Jul. 2, 2019

(54) PRINTING APPARATUS AND PRINTING METHOD

(71) Applicant: SEIKO EPSON CORPORATION, Tokyo (JP)

(72) Inventors: Masayuki Tokunaga, Nagano (JP); Tetsuji Takeishi, Nagano (JP); Shota Hiramatsu, Nagano (JP); Hiroki Chino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 56 days.

(21) Appl. No.: 15/421,612

(22) Filed: Feb. 1, 2017

(65) Prior Publication Data

US 2017/0225494 A1 Aug. 10, 2017

(30) Foreign Application Priority Data

Feb. 9, 2016 (JP) ..... 2016-022786

(51) Int. Cl.
*B41J 13/00* (2006.01)
*B41J 2/01* (2006.01)

(52) U.S. Cl.
CPC ..... *B41J 13/0009* (2013.01); *B41J 2/01* (2013.01)

(58) Field of Classification Search
CPC ..... B41J 11/0005; B41J 29/38; B41J 11/007; B41J 11/42; B41J 13/0009; B41J 13/0018; B41J 13/0027; B41J 13/103; B41J 29/393
USPC ..... 347/16, 19, 101, 104
See application file for complete search history.

(56) References Cited

U.S. PATENT DOCUMENTS

| | | | | |
|---|---|---|---|---|
| 6,375,297 | B1 | 4/2002 | Hayashi et al. | |
| 2009/0003854 | A1 | 1/2009 | Naoi et al. | |
| 2011/0199417 | A1 | 8/2011 | Naoi et al. | |
| 2013/0300795 | A1* | 11/2013 | Ogasawara | B41J 25/3082 347/16 |
| 2014/0152734 | A1* | 6/2014 | Endo | B41J 11/0095 347/16 |

FOREIGN PATENT DOCUMENTS

| | | | |
|---|---|---|---|
| JP | 07-336491 | A | 12/1995 |
| JP | 2000-198189 | A | 7/2000 |
| JP | 2009-006655 | A | 1/2009 |
| JP | 2012-045860 | A | 3/2012 |
| JP | 2016-182695 | A | 10/2016 |
| JP | 2016-183003 | A | 10/2016 |
| JP | 2016-183004 | A | 10/2016 |

* cited by examiner

*Primary Examiner* — Jannelle M Lebron

(57) ABSTRACT

A printing apparatus includes a transporting device that transports a medium and a printing unit that prints onto the medium. In addition, the printing apparatus includes an image sensor that images the medium and a controller that detects a displacement amount of the medium in an intersecting direction which intersects a surface to be printed of the medium based on a plurality of images obtained by imaging the medium by the sensor at different times and that controls the transporting device and the printing unit according to the displacement amount.

17 Claims, 15 Drawing Sheets

PRINTING APPARATUS AND PRINTING METHOD

BACKGROUND

1. Technical Field

The present invention relates to a printing apparatus provided with a transporting unit that transports a medium such as a sheet and a printing unit that prints onto the medium and a printing method.

2. Related Art

In the related art, a printing apparatus that has a transporting unit that transports a medium, including a sheet, and a printing head that prints onto the medium is well known (for example, JP-A-2000-198189, JP-A-2012-45860, and the like).

For example, in order to cause a liquid discharged from a printing head to land at an appropriate position on a medium, a technique of correcting discharge timing according to a gap between the printing head and the medium and a relative moving velocity between the printing head and the medium is disclosed in JP-A-2000-198189.

A printing apparatus that detects a medium jam with photo interrupters provided on an upstream side and a downstream side of a carriage is disclosed in JP-A-2012-45860.

In addition, an image reading apparatus that controls a transporting unit by detecting an oblique movement and a paper jam of a document based on image data obtained by a medium being imaged by a linear image sensor is disclosed in JP-A-7-336491. In this image reading apparatus, it is determined that there is a jam of the document (paper jam) in a case where the fact that oblique movement amounts of the document at different positions are significantly different from each other is detected using a plurality of image sensors provided at different positions on a transporting path of the document.

Meanwhile, since the gap between the medium and the printing head changes once the medium being transported is lifted, a landing position at which ink droplets discharged from the printing head land on the medium deviates from a target position, thereby leading to a decline in print quality. In addition, the lifting of the medium causes a jam or causes the medium to scratch the printing head. In JP-A-7-336491, although the jam of the document can be detected, once time for stopping the driving of the transporting unit is delayed until the oblique movement amounts become significantly different at the different positions at a time of jam occurrence, the jam is intensified and a work of eliminating the jammed medium, including the document becomes complicated for a user. For this reason, it is desirable to detect the lifting of the medium at a time of jam occurrence or the lifting of the medium that causes jam occurrence and to stop the driving of the transporting unit. In addition, once the medium scratches the printing head, the printing head is brought to a state where an appropriate printing cannot be carried out. Accordingly, an extra operation of cleaning the printing head is required to bring the printing head back to a state where an appropriate printing can be carried out. Since such displacement of the medium in the direction (for example, lifted direction) that intersects the surface to be printed of the medium cannot be detected, this type of defect of the printing apparatus attributable to the displacement of the medium in the lifted direction occurs. This type of problem is not related to the type of printing apparatus such as a serial printer, a line printer, and a page printer, and is also not related to a printing system such as an ink jet type and a dot impact type. This problem is common in the printing apparatus.

SUMMARY

An advantage of some aspects of the invention is to provide a printing apparatus and a printing method that can restrict or alleviate printing defect attributable to displacement of a medium in a direction that intersects a surface to be printed of the medium.

Hereinafter, means of the invention and operation effects thereof will be described.

According to an aspect of the invention, there is provide a printing apparatus including a transporting unit that transports a medium, a printing unit that prints onto the medium, a sensor that images the medium, and a control unit that detects a displacement amount of the medium in an intersecting direction which intersects a surface to be printed of the medium based on a plurality of images obtained by imaging the medium by the sensor at different times and that controls at least one of the transporting unit and the printing unit according to the displacement amount.

According to this configuration, the displacement amount of the medium in the intersecting direction that intersects the surface to be printed of the medium is detected based on the plurality of images of the medium imaged by the sensor at different times, and at least one of the transporting unit and the printing unit is controlled according to the displacement amount. Accordingly, for example, printing defect attributable to the lifting of the medium can be restricted or alleviated. Examples of this type of defect include a deviation of a printing position from a target position, scratching of the printing unit by medium, and a medium jam.

In the above printing apparatus, it is preferable that the transporting unit include a velocity detecting unit that detects a transport drive velocity at which the medium is transported by the transporting unit, and the control unit acquire the displacement amount based on a first transport velocity, which is acquired based on the plurality of images obtained by imaging the medium by the sensor at different times, and a second transport velocity, which is the transport drive velocity detected by the velocity detecting unit.

According to this configuration, the displacement amount of the medium in the intersecting direction that intersects the surface to be printed of the medium can be acquired based on the first transport velocity (medium transporting velocity), which is based on the plurality of images obtained by imaging the medium by the sensor at different times, and the second transport velocity (transport drive velocity) detected by the velocity detecting unit. Accordingly, the displacement amount of the medium in the direction that intersects the surface to be printed of the medium can be acquired using the sensor and the velocity detecting unit.

In addition, it is preferable that the above printing apparatus further include an encoder that is capable of detecting a drive amount of the transporting unit, in which the velocity detecting unit acquires the second transport velocity based on an output signal of the encoder.

According to this configuration, the displacement amount of the medium in the direction that intersects the surface to be printed of the medium is acquired based on the first transport velocity, which is based on the plurality of images obtained by imaging the medium by the sensor at different times, and the second transport velocity of the medium, which is based on the output signal of the encoder.

In the above printing apparatus, it is preferable that the control unit displace the medium in a direction of approaching the sensor if the first transport velocity is higher than the second transport velocity and displace the medium in a direction of going further away from the sensor if the first transport velocity is lower than the second transport velocity.

According to this configuration, the medium is displaced in the direction of approaching the sensor if the first transport velocity is higher than the second transport velocity, and the medium is displaced in the direction of going further away from the sensor if the first transport velocity is lower than the second transport velocity. Accordingly, the printing unit can be controlled according to the direction in which the medium is displaced in the direction that intersects the surface to be printed.

In the above printing apparatus, it is preferable that the control unit acquire the displacement amount based on a difference in sizes per unit time or a difference in movement amounts per unit time of an object that is focused on in an image obtained by imaging the medium by the sensor for each unit time.

According to this configuration, in the image of the medium imaged by the sensor, the object that is focused on is acquired. The displacement amount of the medium in the intersecting direction is acquired based on the difference in sizes per unit time or the difference in movement amounts per unit time of the object in the image. Accordingly, the displacement amount of the medium in the intersecting direction can be acquired even if the second transport velocity detected by the velocity detecting unit is not used. For example, the disuse of the velocity detecting unit is possible.

In the above printing apparatus, it is preferable that the control unit acquire the difference in sizes per unit time using a previous size of the object in a previous image obtained by imaging the medium by the sensor for each unit time and a current size of the object in a current image and acquire the displacement amount based on the difference in sizes per unit time.

According to this configuration, the difference in sizes of the object per unit time is acquired using the previous size of the object in the previous image obtained by imaging the medium by the sensor for each unit time and the current size of the object in the current image. Then, the displacement amount of the medium in the intersecting direction is acquired based on the difference in sizes of the object per unit time. Accordingly, the displacement amount of the medium in the intersecting direction can be acquired even if a detected value (transporting velocity) of the velocity detecting unit is not used.

In the above printing apparatus, it is preferable that the control unit increase the displacement amount of the medium in a direction of approaching the printing unit as the current size of the object becomes larger than the previous size of the object.

According to this configuration, the displacement amount (for example, lifted amount) of the medium in the direction of approaching the printing unit increases as the current size of the object becomes larger than the previous size of the object. Accordingly, the lifted amount of the medium can be detected based on the image obtained by imaging the medium. Even if, for example, sliding of the medium on transporting unit or a change in the drive velocity of the transporting unit occurs, the displacement amount of the medium in the direction that intersects the surface to be printed of the medium can be acquired without being affected by these factors.

In the above printing apparatus, it is preferable that the control unit acquire a per-unit displacement amount, which is a displacement amount of the medium in the intersecting direction per unit time based on a difference between the previous size of the object and the current size of the object and acquire the displacement amount of the medium in the intersecting direction by adding up the per-unit displacement amount.

According to this configuration, the previous size of the object in the previous image and the current size of the object in the current image are acquired by the medium being imaged by the sensor for each unit time. The per-unit displacement amount, which is a displacement amount of the medium in the intersecting direction per unit time based on the difference between the previous object size and the current object size is acquired and the displacement amount of the medium in the intersecting direction is acquired by the per-unit displacement amounts being added up. Even if the sliding between the transporting unit and the medium, or the change in the transporting velocity of the medium occurs, the displacement amount of the medium in the intersecting direction that intersects the surface to be printed of the medium can be acquired without being affected by these factors.

In the above printing apparatus, it is preferable that the control unit acquire a gap between the printing unit and the medium according to the displacement amount.

According to this configuration, the gap between the printing unit and the medium changes according to the displacement amount of the medium in the intersecting direction. Since control unit acquires the gap between the printing unit and the medium according to the displacement amount of the medium in the intersecting direction, the control unit can control, for example, the printing unit according to the gap of each time.

In the above printing apparatus, it is preferable that the sensor be disposed at a position where an unprinted area of the medium can be imaged on an upstream side of the printing unit in a transporting direction of the medium, the printing unit be a liquid discharging system that discharges a liquid onto the medium to print, and the control unit correct discharge timing of the printing unit according to the gap.

According to this configuration, the control unit acquires the gap that changes according to the displacement amount of the medium in the intersecting direction and corrects the discharge timing of the printing unit according to the acquired gap. Accordingly, an appropriate printing can be carried out onto the medium by the liquid discharged from the printing unit being landed at an appropriate position.

In the above printing apparatus, it is preferable that the printing unit be capable of moving in a width direction that intersects a transporting direction of the medium, the sensor be provided as a pair at portions on both sides of the printing unit in a moving direction, and the control unit correct discharge timing of the printing unit based on the gap, which is acquired based on an obtained image captured by one sensor disposed on a portion of the printing unit on a leading side in the moving direction out of the pair of sensors.

According to this configuration, out of the pair of sensors provided at the portions on both sides of the printing unit in the moving direction, the gap is acquired based on the obtained image captured by one sensor disposed at the portion of the printing unit on the leading side in the moving direction, and the discharge timing of the printing unit is corrected based on the acquired gap. Accordingly, the gap can be acquired relatively accurately based on the image obtained by the sensor imaging the unprinted area of the medium to be printed from now, and an appropriate printing can be carried out on the medium by the liquid being discharged at the appropriate discharge timing according to this acquired gap.

In the above printing apparatus, it is preferable that the control unit stop driving of the transporting unit once a threshold of the displacement amount is exceeded.

According to this configuration, the control unit stops the driving of the transporting unit once the displacement amount of the medium in the intersecting direction that intersects the surface to be printed of the medium exceeds the threshold. For example, the driving of the transporting unit is stopped once a jam occurs and the displacement amount of the medium in the direction that intersects the surface to be printed of the medium exceeds the threshold. As a result, after the jam occurrence, by the driving of the transporting unit being stopped relatively early, the jam can be alleviated.

It is preferable that the above printing apparatus further include a gap adjusting unit that adjusts a gap between the printing unit and the medium, in which the control unit controls the gap adjusting unit according to the displacement amount.

According to this configuration, the control unit controls the gap adjusting unit according to the displacement amount of the medium in the direction that intersects the surface to be printed of the medium. For example, the control unit adjusts the gap to have an appropriate value according to the displacement amount, or avoids the displaced medium sliding on the printing unit.

According to another aspect of the invention, there is provided a printing method to solve the above problems, which is the printing method for a printing unit that prints onto a medium transported by a transporting unit, including detecting a displacement amount of the medium in an intersecting direction which intersects a surface to be printed of the medium based on a plurality of images obtained by imaging the medium at different times and controlling at least one of the transporting unit and the printing unit based on the displacement amount. According to this method, the same operation effects as that of the above printing apparatus can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment for a printing apparatus will be described with reference to the drawings.

Figure 1:
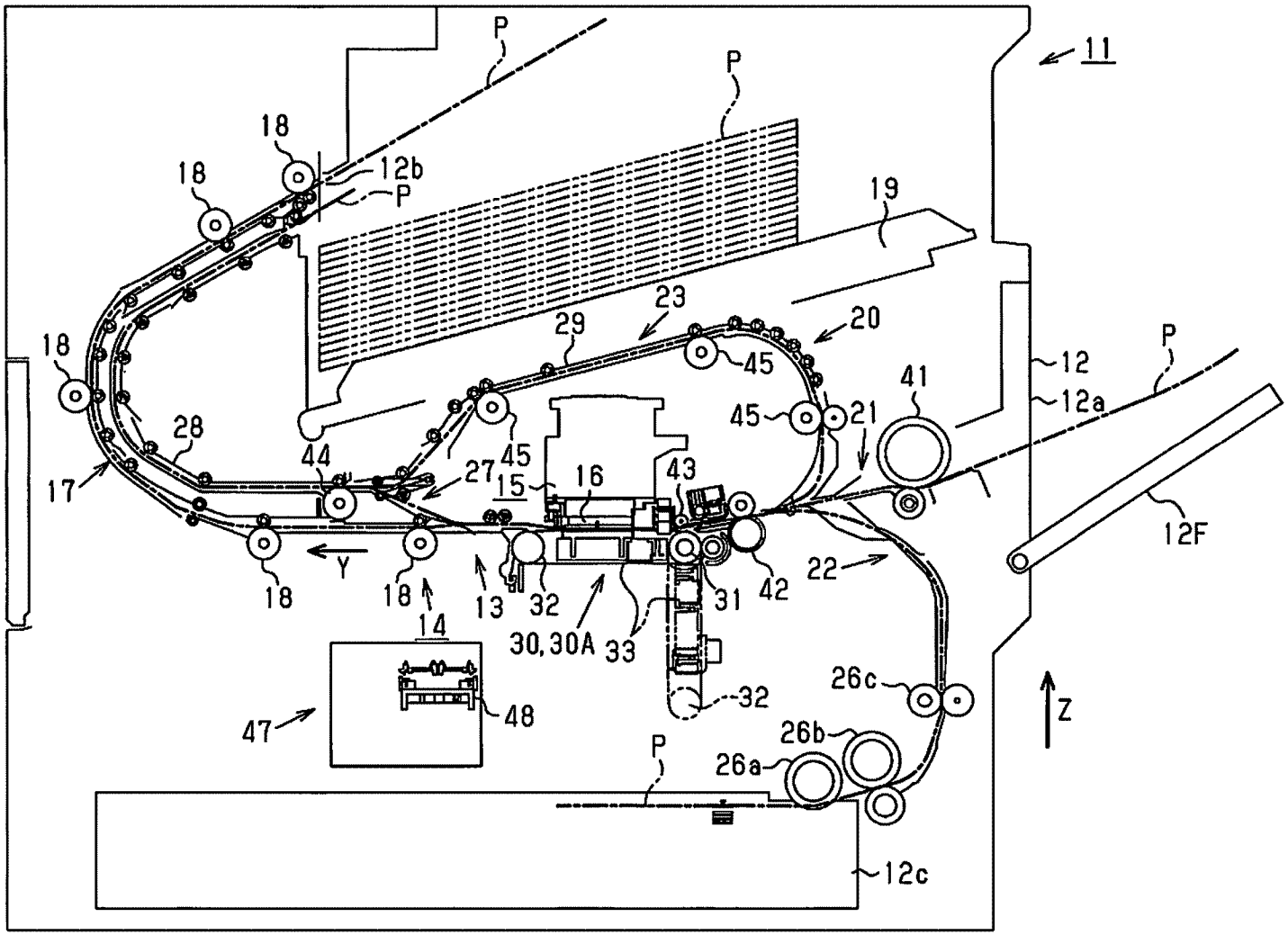
FIG. 1 is a schematic side sectional view illustrating a printing apparatus in a first embodiment.

A printing apparatus 11 of this embodiment illustrated in FIG. 1 is a line printer. A transporting device 14 that is an example of a transporting unit that transports a medium P, such as a sheet, along a medium transporting path 13 and a printing unit 15 that is an example of a printing unit that prints onto the medium P being transported are provided inside a housing 12 of the printing apparatus 11.

The printing unit 15 is provided with a line head-type printing head 16 that extends in a width direction W orthogonal to the page of the FIG. 1, and adopts a line printing system in which the printing head 16 simultaneously prints one line width onto the medium P being transported. The printing head 16 of this example is an ink jet system (liquid discharging system), and discharges ink droplets onto the medium P to print an image or a document.

The transporting device 14 is provided with a feeding mechanism unit 20 that feeds the medium P before printing onto the medium transporting path 13, a transporting mechanism 30 that transports the medium P at a regular transporting velocity when the printing head 16 prints, and an outputting mechanism unit 17 that outputs the printed medium P outside the housing 12. The outputting mechanism unit 17 outputs the medium P from a medium output port 12*b* to the outside of the housing 12 by means of a plurality of pairs of output rollers 18 disposed along an output path. As illustrated as two-dot chain lines in FIG. 1, the output medium P is stacked onto a placing base 19.

The feeding mechanism unit 20 has a first feeding unit 21, a second feeding unit 22, and a third feeding unit 23, each of which has a different source of feeding. By a first pair of feeding rollers 41 being rotated, the first feeding unit 21 feeds the medium P, to the transporting mechanism 30, inserted into the housing 12 from an insertion port 12*a* that is exposed once a feeding tray 12F, which also serves as a cover, provided on one side surface (right surface in FIG. 1) of the housing 12 is opened. In addition, a pair of feeding rollers 42 are disposed at positions slightly on a downstream side of a junction point of the first to third feeding units 21 to 23 in the transporting direction, and the fed medium P is transported to the transporting mechanism 30 by the pair of feeding rollers 42 being rotated. In addition, a driven roller 43 is disposed at a position in an upper end portion of the transporting mechanism 30 on the upstream side in the transporting direction.

In addition, the second feeding unit 22 feeds, one by one, a plurality of media P accommodated in a state of being stacked in a cassette 12*c* provided in a lower portion of the housing 12. The second feeding unit 22 is provided with a pickup roller 26*a* that sends out the uppermost medium P inside the cassette 12*c*, a pair of separation rollers 26*b* that separate the sent-out medium P into one piece, and a second pair of feeding rollers 26*c* that feed the separated medium P to the transporting mechanism 30.

The third feeding unit 23 is a supplying unit for again leading the medium P of which one surface is printed and reversed front and back to the transporting mechanism 30 when performing double-sided printing onto the medium P. The medium P of which only one surface is printed and which is output from the transporting mechanism 30 is led onto a branched transporting path 28 by a branching mechanism 27. By a pair of reversing rollers 44 being reversely rotated after a forward rotation, the medium P is led from the branched transporting path 28 to a reverse supply path 29 positioned above the printing unit 15 in FIG. 1. Then, by a plurality of pairs of reverse transporting rollers 45 being rotated, the medium P is led along the reverse supply path 29 to the junction point between the medium transporting path 13 and the reverse supply path 29, and after then is fed again to the transporting mechanism 30 by the pair of feeding rollers 42. The medium P that went through double-sided printing by an unprinted surface of the medium P fed again to the transporting mechanism 30 being printed by the printing head 16 is output from the medium output port 12*b* to the outside of the housing 12 through the outputting mechanism unit 17.

The transporting mechanism 30 is disposed in a printing region opposing the printing head 16. The transporting mechanism 30 of this embodiment is configured of an electrostatic adsorption-type belt transporting mechanism 30A. The belt transporting mechanism 30A has a pair of rollers 31 and 32 and an endless transporting belt 33 that is wound around the pair of rollers 31 and 32. The transporting mechanism 30 transports the medium P at a constant velocity by the transporting belt 33 being rotated at a constant rotation velocity while supporting a printing region portion of the medium P on the transporting belt 33 in a state where a regular gap between the printing head 16 and the medium P is maintained. Then, an image or the like is printed onto the medium P by the printing head 16 discharging inks toward the printing region of the medium P transported at a constant velocity. The medium P, at this time of printing, is electrostatically adsorbed onto an outer surface of the transporting belt 33. Instead of the belt transporting mechanism 30A, the transporting mechanism 30 may be configured as a roller-transporting mechanism provided with a supporting base having a support surface that supports the medium P and a plurality of pairs of transporting rollers disposed on both sides of the supporting base in a transporting direction Y.

In addition, as illustrated in FIG. 1, a maintenance device 47 that maintains the printing head 16 is provided in the printing apparatus 11. The transporting mechanism 30 moves between a transporting position marked by a solid line in FIG. 1 and a retract position marked by the two-dot chain line by being rotated about a roller 31 by a moving device (not illustrated) on the upstream side in the transporting direction. Then, under a state where the transporting mechanism 30 has retracted to the retract position, the maintenance device 47 is disposed from the retract position illustrated in FIG. 1 to a maintenance position (not illustrated) opposing the lower side of the printing head 16 and performs maintenance of inhibiting or addressing the clogging of nozzles of the printing head 16 or the like.

Hereinafter, the configuration and control of the printing unit 15 and the transporting mechanism 30 will be described in detail with reference to FIG. 2 to FIG. 4. A direction that intersects (is orthogonal to, in particular) a surface to be printed Pa of the medium P being transported in a regular posture with no lifting by the pair of feeding rollers 42 and the transporting belt 33 is referred to as an intersecting direction Z. In other words, a direction that intersects the medium support surface (in this example, the outer surface of the transporting belt 33) of the transporting mechanism 30 supporting the medium P when the printing head 16 prints is the intersecting direction Z. In this example, the intersecting direction Z coincides with a vertical direction but the intersecting direction Z is a direction appropriately determined by the posture of the medium P when printing.

Figure 2:
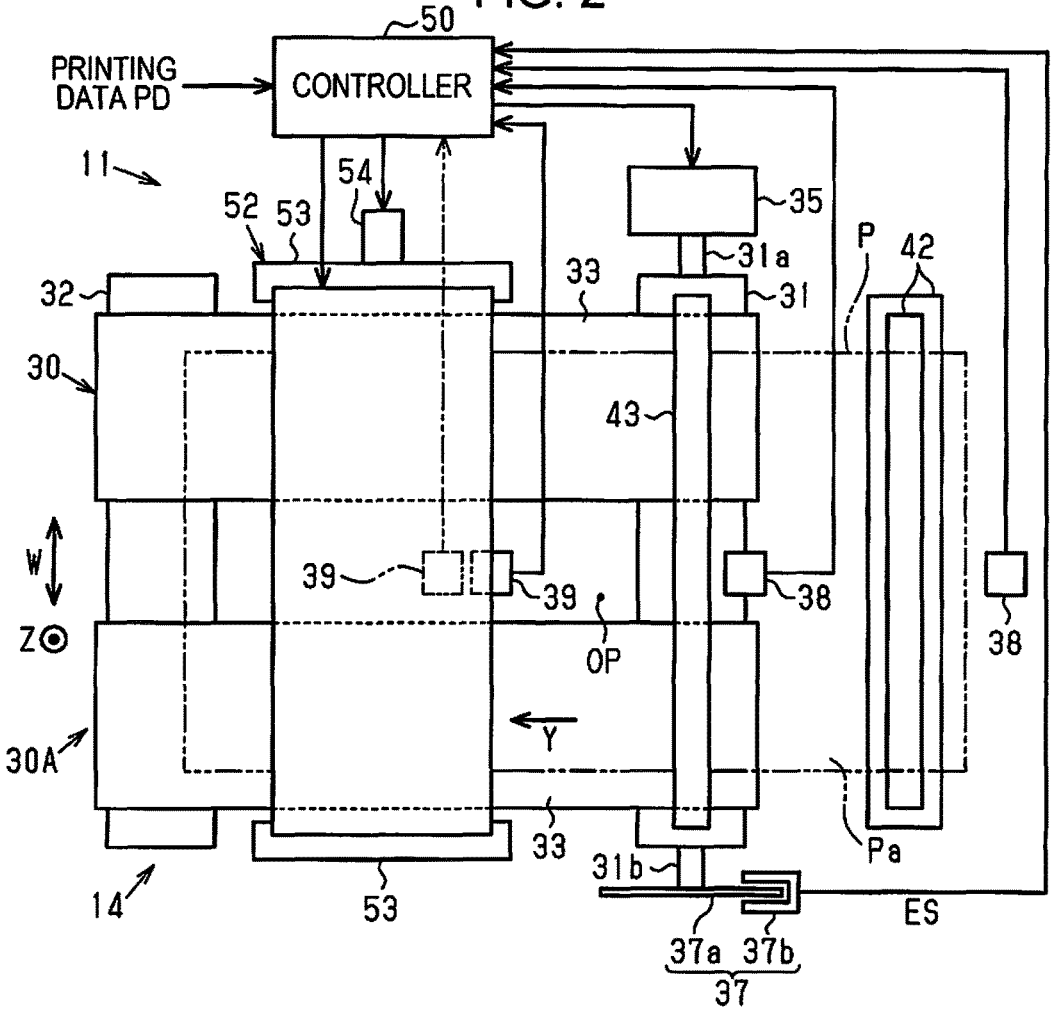
FIG. 2 is a schematic plan view illustrating a transporting mechanism and a printing unit.
Figure 3:
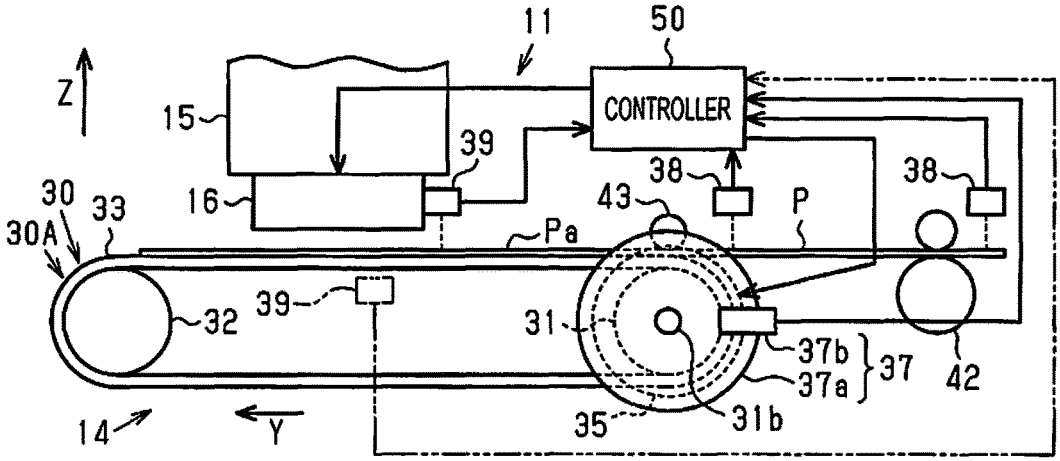
FIG. 3 is a schematic side view illustrating the transporting mechanism and the printing unit.

As illustrated in FIG. 2 and FIG. 3, the printing apparatus 11 is provided with the printing unit 15, the transporting mechanism 30 that configures an example of the transporting unit, and a controller 50, which is an example of a control unit that controls the printing unit 15 and the transporting mechanism 30. The printing unit 15 has a long shape that extends in the width direction W that intersects (is orthogonal to, in particular) the transporting direction Y of the medium P. The belt transporting mechanism 30A that configures the transporting mechanism 30 is provided with the pair of rollers 31 and 32 disposed so as to be separated at a predetermined interval in the transporting direction Y and a plurality of (two, in an example of FIG. 2) transporting belts 33 wound around the pair of rollers 31 and 32. An output shaft of a transporting motor 35, which is one of power sources of the transporting device 14, is connected to a shaft unit 31*a* of the roller 31 on a drive side, which is disposed on the upstream side in the transporting direction. In addition, the driven roller 43 which is capable of accompanying rotation by coming into contact with the transporting belt 33 is disposed at a position above the transporting belts 33 of the roller 31 so as to be interposed between the transporting belts 33. The power of the transporting motor 35 is also transmitted via a train wheel (gear train) (not illustrated) to rollers, which are other transporting systems such as drive rollers of the pair of feeding rollers 42. The transporting mechanism 30 and the pair of feeding rollers 42 may be driven independently of each other by the separate transporting motor 35. In addition, the first pair of feeding rollers 41, the pickup roller 26*a*, the second pair of feeding rollers 26*c*, and the like are driven by the power of each of separate feeding motors (not illustrated).

The pair of feeding rollers 42 disposed at positions slightly on the upstream side of the transporting mechanism 30 in the transporting direction Y have a function of a resist roller that determines timing of transporting the medium P to the transporting mechanism 30. Before being sent into the transporting mechanism 30, the removal of the skew (oblique movement) of the medium P is performed, for example, by a leading end of the medium P being struck by the pair of stopped feeding rollers 42. After then, the medium P after the skew removal is initiated to be transported on the transporting belt 33 by the pair of feeding rollers 42 being rotated.

Figure 4:
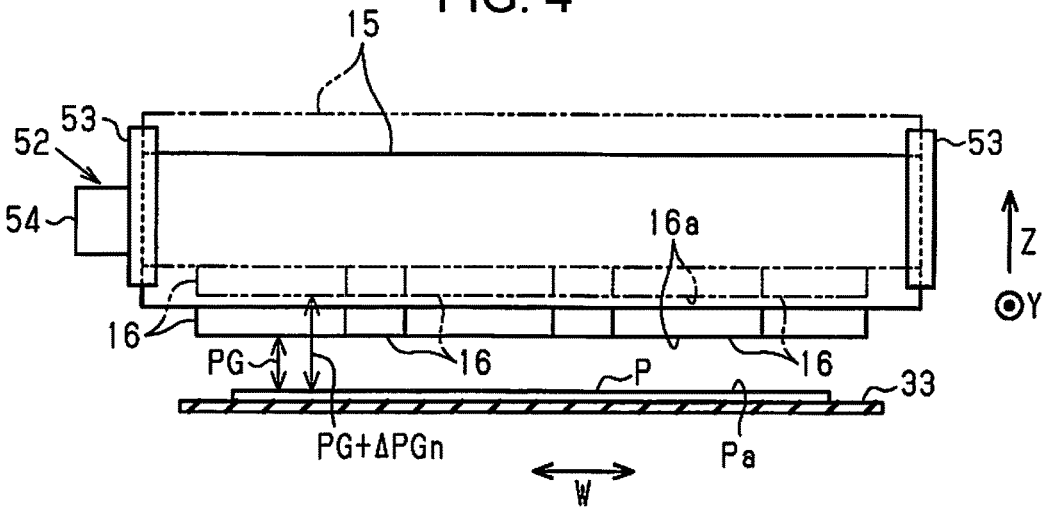
FIG. 4 is a schematic front view illustrating the printing unit.

In addition, as illustrated in FIG. 2 and FIG. 4, the printing apparatus 11 is provided with a gap adjusting device 52, which is an example of a gap adjusting unit capable of adjusting a gap PG (interval) between the printing head 16 and the medium P by moving the printing unit 15 in the intersecting direction Z so as to be able to come near to or be spaced away from the transporting belt 33. The gap adjusting device 52 is provided with a pair of guide units 53 that guide the printing unit 15 in the intersecting direction Z and an electric motor 54 that is a power source giving power for moving the printing unit 15 in the intersecting direction Z. Then, the controller 50 causes the electric motor 54 to be forward rotation-driven or reverse rotation-driven to move the printing unit 15 in one direction or the other direction of the intersecting direction Z, thereby adjusting the gap PG.

By the gap adjusting device 52 being driven, the gap is adjusted so as to be a regular gap PG0 according to a printing mode and a medium type (for example, a sheet type), which are included in printing condition information included in printing data PD received from a host device (not illustrated) or which are included in printing condition information input through an operation panel (not illustrated). In this embodiment, the intersecting direction Z is set to a direction parallel to a direction in which the medium P is lifted from the medium support surface such as the outer surface of the transporting belt 33.

In addition, the printing apparatus 11 is provided with a rotary encoder 37, which is an example of an encoder capable of detecting a drive amount of the transporting mechanism 30. The rotary encoder 37 (hereinafter, also simply referred to as an "encoder 37") has a discoid scale plate 37*a* capable of integrally rotating with a shaft unit 31*b* of the roller 31 that configures the transporting mechanism 30 and an optical sensor 37*b* that optically detects multiple light transmitting units (not illustrated) formed at a regular pitch on a circumferential portion of the scale plate 37*a* in a circumferential direction. The encoder 37 is outputs an encoder pulse signal ES (hereinafter, also referred to as "encoder signal ES") in which the number of pulses is proportional to the rotation amount of the roller 31. The encoder signal ES output from the encoder 37 is input to the controller 50. The controller 50 detects, based on the encoder signal ES input from the encoder 37, a transport drive velocity Vd, which is a drive velocity (peripheral velocity) on surfaces (for example, outer peripheral surfaces) of the transporting belt 33 and the pair of feeding rollers 42 that come into contact with the medium P. Herein, a medium transporting velocity Vp, which is a moving velocity of the medium P transported by the transporting belt 33 and the pair of feeding rollers 42 in the transporting direction Y coincides with the transport drive velocity Vd if the medium P is transported in the transporting direction Y without sliding. However, the transport drive velocity Vd does not coincide with the medium transporting velocity Vp when the medium P minutely slides on the outer peripheral surfaces of the transporting belt 33 and the pair of feeding rollers 42 or the velocity of the transporting belt 33 or the pair of feeding rollers 42 changes. In addition, a jam occurs at the pair of feeding rollers 42 or a landing position deviation of ink droplets discharged from the printing head 16 occurs when the medium P being transported is lifted due to curling.

In addition, the printing data PD is input to the controller 50. The controller 50 controls the transporting motor 35 so as to be driven at a constant drive velocity according to the printing mode. The medium P is transported at a constant medium transporting velocity Vp in the transporting direction Y. The controller 50 controls the printing unit 15 based on the input printing data PD, and causes the ink droplets to be discharged at a regular discharge timing toward the medium P being transported at a constant medium transporting velocity Vp from the printing unit 15, thereby printing an image or a document onto the medium P based on the printing data PD. Accordingly, print dots are formed by ink droplets landing on the medium P at a regular dot pitch determined by the medium transporting velocity Vp and the discharge timing (discharge cycle) in the transporting direction Y. As a result, an image or the like is printed onto the medium P based on the printing data PD with predetermined printing resolution according to the printing mode.

In addition, the printing apparatus 11 is provided with image sensors 38 and 39, which are examples of sensors imaging the medium P. The image sensors 38 and 39 are formed of, for example, area sensors. The controller 50 detects a displacement amount of the medium P in the intersecting direction Z (lifted direction) that intersects the surface to be printed Pa of the medium P based on two-dimensional image data obtained by the image sensors 38 and 39 imaging at different times.

In examples of FIG. 2 and FIG. 3, the two image sensors 38 image the medium P at positions where a medium jam is likely to occur. One image sensor 38, out of the two image sensors 38, images the medium P at a position immediately on the upstream side of the pair of feeding rollers 42 in the transporting direction Y. The other image sensor 38 images the medium P at a position immediately on the upstream side of a place where the medium is nipped between the transporting belt 33 and the driven roller 43 in the transporting direction Y. That is because when the medium jam occurs, a portion of the medium P immediately on the upstream side of a place where the medium P is nipped at the pair of feeding rollers 42 or the driven roller 43 is started to be lifted first. From a plurality of images obtained by imaging the medium P for each unit time, the image sensor 38 outputs a detection signal required for acquiring the displacement amount of the medium P in the intersecting direction Z to the controller 50. The controller 50 detects a lifted amount (hereinafter, also referred to as a "lift amount") of the medium P based on the detection signal from the image sensor 38. In addition, the controller 50 detects the gap PG that changes according to the displacement amount (lifted amount) of the medium P in the intersecting direction Z based on the detection signal from the image sensor 39.

In addition, as illustrated in FIG. 2 and FIG. 3, the image sensor 39 outputs the detection signal required for measuring the gap PG (refer to FIG. 4) between the printing head 16 and the medium P to the controller 50. For this reason, the image sensor 39 images the medium P at a position near to the printing head 16.

In the example of FIG. 3, the image sensor 39 is fixed to a side surface of the printing head 16 on the upstream side in the transporting direction and images an outer surface of the medium P. The image sensor 39 is disposed at a position where the unprinted area of the medium P, before being printed by the printing unit 15, can be imaged in a relative movement direction (transporting direction Y) between the printing unit 15 and the medium P. In particular, the image sensor 39 of this example is disposed at a position on the upstream side of the most upstream nozzle of the printing head 16 in the transporting direction Y, and images the unprinted area of the medium P before the inks are applied.

In addition, as marked by the two-dot chain line in FIG. 2 and FIG. 3, the image sensor 39 may be disposed at a position on a side opposite to the printing head 16 with respect to the transporting path of the medium P to cause the image sensor 39 to image a surface (back surface) of the medium P on the side opposite to a printing head 16 side. In the examples of FIG. 2 and FIG. 3, the image sensor 39 is linked to the transporting mechanism 30. Specifically, the image sensor 39 is disposed at a position corresponding to a clearance OP between the transporting belts 33 in the belt transporting mechanism 30A or at a position on the upstream side of the most upstream nozzle of the printing head 16 in the transporting direction Y. That is to avoid becoming dirty with the inks since the image sensor 39 is likely to become dirty due to the inks when the ink droplets are discharged from the nozzles in a state where the medium P does not exist between the printing head 16 and the image sensor 39 when the image sensor 39 is positioned below the nozzles. In addition, it is highly unlikely that the image sensor 39 gets dirty with the inks by the adhesion of some inks discharged from the printing head 16 for cleaning since the image sensor 39 retracts to the retract position (position of the two-dot chain line in FIG. 1) along with the transporting mechanism 30 at a time of cleaning.

The controller 50 illustrated in FIG. 2 and FIG. 3 sequentially detects the present gap PG based on the detection signal from the image sensor 39. The discharge timing of the inks from the printing head 16 is required to be controlled to cause the ink droplets discharged from the printing head 16 to land at a target position on the medium P when the printing head 16 and the medium P are relatively moving. At this time, the discharge timing is required to be controlled according to discharge velocities Vm of the ink droplets, a transporting velocity Vp (medium transporting velocity) of the medium P, and the gap PG. The discharge velocities Vm of the ink droplets are determined according to the sizes (weights) of the ink droplets, and the discharge timing according to the size of each of the ink droplets is adjusted by a head drive circuit 55 inside the printing head 16 in this example. The controller 50 acquires the medium transporting velocity Vp based on the detection signal of the image sensor 39. Once medium P slides on the transporting belt 33, the medium transporting velocity Vp changes even when the drive velocity of the transporting belt 33 is constant. For this reason, the controller 50 generates a printing timing signal PTS that determines the discharge timing of the printing head 16 based on the medium transporting velocity Vp, which is acquired based on the detection signal input from the image sensor 39, and the gap PG.

The controller 50 acquires a displacement amount ΔZ of the medium P in the intersecting direction Z (lifted direction) based on the detection signal from the image sensors 38 and 39 and controls both of the transporting device 14 and the printing unit 15 based on this displacement amount ΔZ. In this embodiment, the controller 50 stops the driving of the transporting device 14 when the displacement amount ΔZ based on the detection signal from the image sensor 38 exceeds a threshold. In addition, when the displacement amount ΔZ based on the detection signal from the image sensor 39 exceeds the threshold, the controller 50 drives the gap adjusting device 52 to control the gap so as to widen. In addition, in this embodiment, the controller 50 corrects the printing timing signal PTS based on the gap PG determined according to the displacement amount ΔZ which is based on the detection signal from the image sensor 39. Since the controller 50 outputs the printing timing signal PTS corrected according to the medium transporting velocity Vp and the gap PG to the printing head 16, the dot pitch of the print dots in the transporting direction Y can be printed with reasonable printing resolution.

Figure 5:
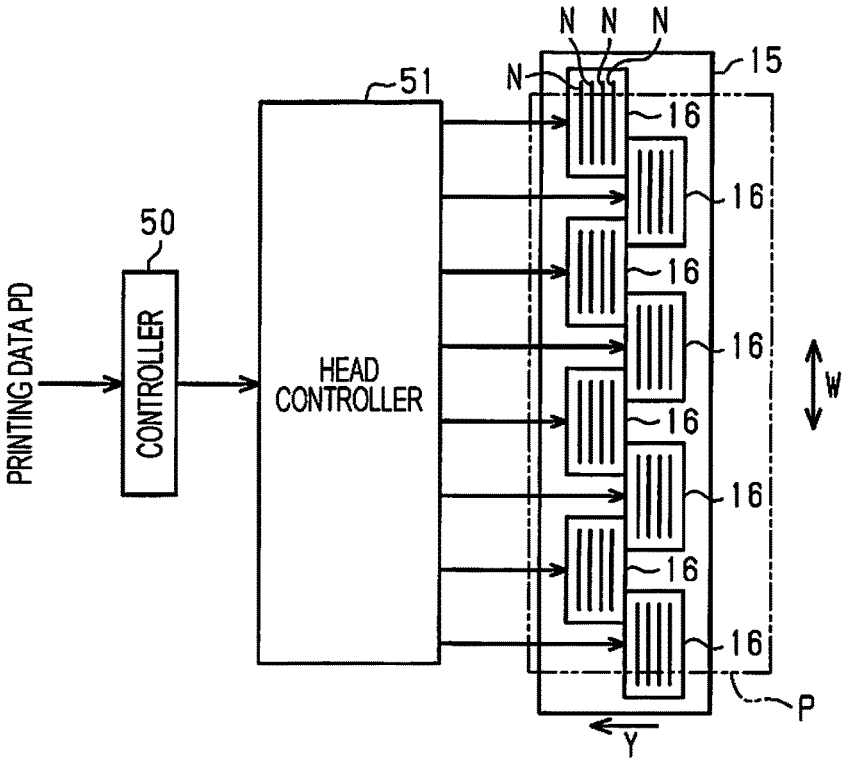
FIG. 5 is a schematic view illustrating the printing unit and a control system thereof.

Hereinafter, a configuration of the printing unit 15 will be descried with reference to FIG. 5 and FIG. 6. As illustrated in FIG. 5, the printing unit 15 has a predetermined length such that printing over the entire width of the medium P having a maximum width is possible. The printing unit 15 of this example is a so-called multi-head type in which a plurality of printing heads 16 are arranged in a longitudinal direction thereof in a predetermined disposition pattern. On a nozzle opening surface 16*a* of the printing head 16, a plurality of types (for example, four types in FIG. 5) of nozzle lines N are provided. The same type (for example, the same ink color) of nozzle lines N of the printing heads 16 are disposed so as to be continuously distributed in a nozzle line direction (width direction W). For this reason, in this printing apparatus 11, full-width printing on the medium P having the maximum width can be carried out by the same type of nozzle lines N of each printing head 16.

As illustrated in FIG. 5, the controller 50 is electrically connected to the plurality of printing heads 16 via a head controller 51. The controller 50 causes a nozzle 161 (refer to FIG. 6) of each of the printing heads 16 to discharge the ink droplets by each piece of distribution data obtained by dividing the input printing data PD into a plurality of pieces being transmitted via the head controller 51 to each corresponding printing head 16. An image or the like is printed onto the medium P based on the printing data PD by the ink droplets discharged from each of the printing heads 16 being landed on the outer surface of the medium P being transported.

Figure 6:
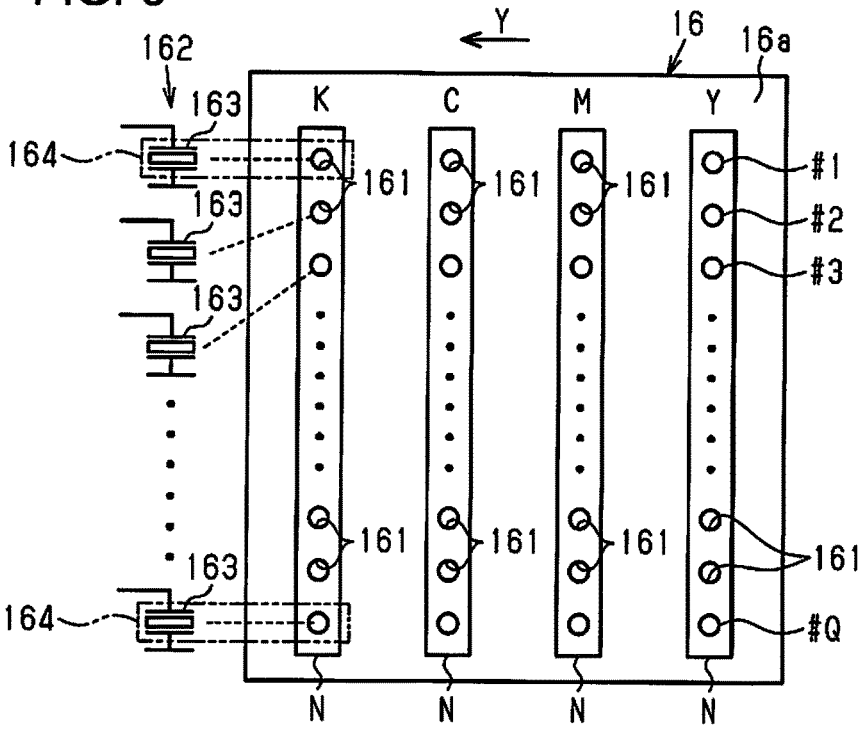
FIG. 6 is schematic view illustrating a bottom surface of a printing head and a discharge drive system.

As illustrated in FIG. 6, the plurality of (four in FIG. 6) nozzle lines N provided on the nozzle opening surface 16*a* of the printing head 16 are configured of Q (in FIG. 6, Q=360) nozzles #1 to #Q arranged in a line at a regular nozzle pitch in a direction (nozzle line direction) that intersects the transporting direction Y of the medium P. The nozzles 161 discharge different colors of ink droplets for each nozzle line N. In an example of FIG. 6, the plurality of nozzle lines N discharge each of four colors, including black (K), cyan (C), magenta (M), and yellow (Y), of ink droplets.

As illustrated in FIG. 6, one discharge drive element group 162 is mounted for each nozzle line in the printing head 16. The discharge drive element group 162 has the same number of discharge drive elements 163 as the number of nozzles of each nozzle line. The same number of discharging units 164, which have the nozzles 161 and the discharge drive elements 163, as the number of nozzles per each nozzle line are provided in the printing head 16. In FIG. 6, only a part of the discharge drive element 163 corresponding to the nozzle 161 is schematically drawn on an outer side of the printing head 16.

The discharge drive element 163 illustrated in FIG. 6 is formed of, for example, a piezoelectric element or an electrostatic drive element. Once a drive pulse (voltage pulse) having a predetermined wave form is applied, a diaphragm (not illustrated) formed of a part of a wall portion of an ink chamber (cavity) that communicates with the nozzle 161 is vibrated due to an electrostrictive effect or an electrostatic drive effect. Accordingly, the ink chamber is expanded or compressed, and thereby the discharge drive element 163 causes the ink droplets to be discharged from the nozzle 161. Without being limited to a piezoelectric system and an electrostatic system, the printing head 16 may be a thermal system in which the ink droplets are discharged from the nozzle 161 through an expansion pressure of bubbles generated by film-boiling the inks heated by a discharge drive element formed of a heater element.

Figure 7:
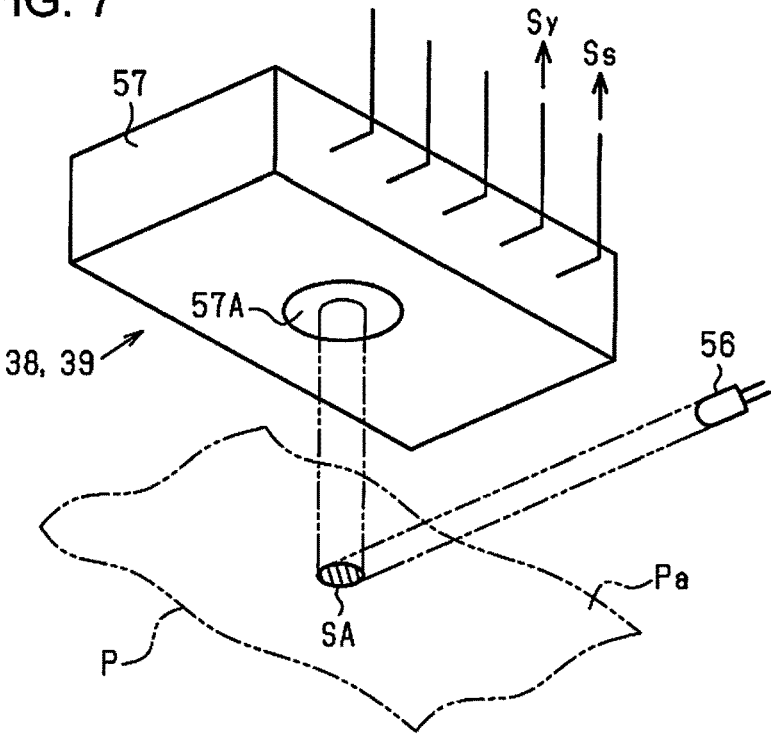
FIG. 7 is a schematic perspective view illustrating an image sensor.

Hereinafter, configurations of the image sensors 38 and 39 will be described with reference to FIG. 7. As illustrated in FIG. 7, the image sensors 38 and 39 are provided with a light emitting unit 56 capable of emitting light onto the outer surface of the medium P and an IC component 57 in which an imaging element 40 (refer to FIG. 8 and FIG. 9) is mounted. The imaging element 40 captures an image that has received light through a transparent window unit 57A. The light emitting unit 56 is formed of a light emitting diode capable of emitting, for example, laser light. The light emitting unit 56 and the IC component 57 are disposed so as to have a predetermined positional relationship in which the laser light emitted by the light emitting unit 56 to the medium P is reflected and then is incident to the window unit 57A.

The IC component 57 acquires two-dimensional image data for each unit time obtained by the imaging element 40 imaging the texture (medium outer surface pattern) inside a light irradiation region SA on the medium P and outputs, from one output pin, a detection signal Sy indicating a value according to a movement amount An (hereinafter, also referred to as a "per-unit transported amount An") of the medium P per unit time in the transporting direction Y, which is based on comparison between previous and current image data.

In addition, the IC component 57 outputs, from the other output pin, a detection signal Ss indicating a value according to a distance (imaging distance) to the medium P based on comparison between the previous and current image data obtained by the imaging of the imaging element 40.

Figure 8:
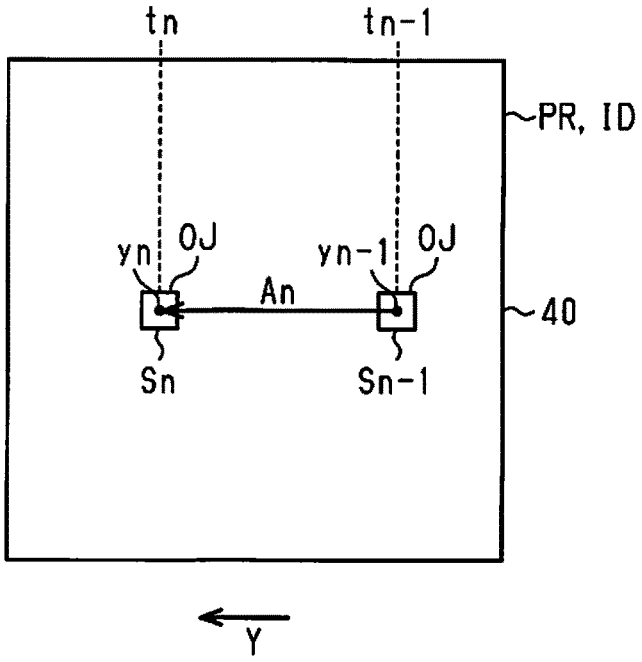
FIG. 8 is a schematic view illustrating imaging results when a medium is kept at a regular gap.
Figure 9:
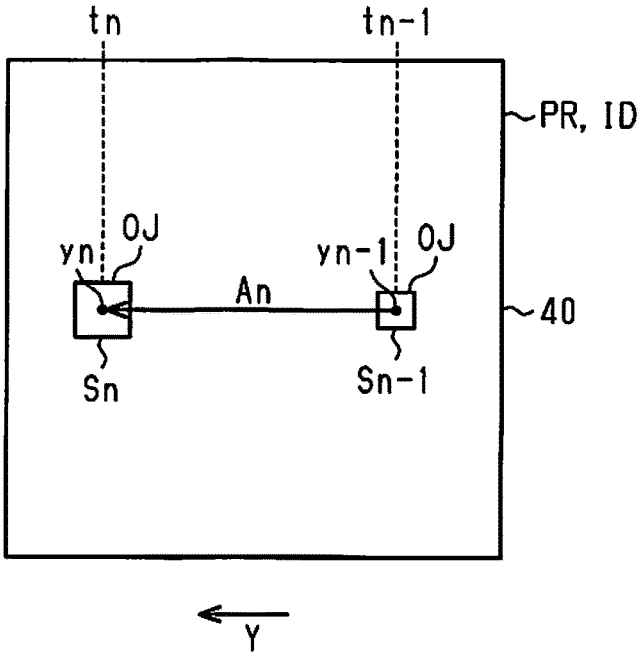
FIG. 9 is a schematic view illustrating imaging results when the medium is in the middle of being lifted.

FIG. 8 and FIG. 9 illustrate a pixel region of an imaging element that configures an image sensor. As illustrated in FIG. 8 and FIG. 9, the imaging elements 40 of the image sensors 38 and 39 are provided with a pixel region PR formed of a two-dimensional pixel group in which pixels formed by one light receiving element are disposed in an n×m matrix. Image data ID that has each pixel value according to a light receiving amount of each pixel in the pixel region PR for each unit time is generated. In view of this point, FIG. 8 and FIG. 9 are views illustrating the image data ID. Hereinafter, the detection signals Sy and Ss of the image sensors 38 and 39 will be described using the image data ID in FIG. 8 and FIG. 9.

First, detection signal Sy generation processing will be described with reference to FIG. 8. The image sensors 38 and 39 select an object OJ, which is formed of minute regions, to be focused on as a tracking target in the image data ID to measure the per-unit transported amount An and the like. FIG. 8 illustrates the image data ID indicating two objects OJ of different times in one image when the imaging distance between the image sensors 38 and 39 and the medium P is kept constant, and illustrates the object OJ (on the right in FIG. 8) of time t−1 and the object OJ (on the left in FIG. 8) of time t in the image data ID. Control circuits (not illustrated) inside the image sensors 38 and 39 set the object OJ of the time t−1 so as to be at a position close to the upstream side in the transporting direction Y in the previous image data ID and acquire a positional coordinate yn−1 of this object OJ in the transporting direction Y. The current image data ID acquired after a unit time Δt from then is searched for the object OJ previously set, and a positional coordinate yn of the object OJ of the time t in the transporting direction Y found by the search is acquired. The control circuits of the image sensors 38 and 39 calculate a difference between the positional coordinates yn−1 and yn and acquire the per-unit transported amount An (=yn−yn−1) of the medium P. Then, the image sensors 38 and 39 output the detection signal Sy that includes the value of the per-unit transported amount An.

Hereinafter, detection signal Ss generation processing will be described with reference to FIG. 8 and FIG. 9. A belt outer surface (medium support surface) when there is no bending in the transporting belt 33 on which the medium P is supported at a time of printing is set as a reference surface, and a distance between the image sensors 38 and 39 and the medium P when the lift amount of the medium P from the reference surface in the intersecting direction Z is "0 (zero)" is set as a specified distance. The image data ID of FIG. 8 is data obtained when the imaging distance is kept constant at the specified distance. In the image data ID, an object size value Sn−1 indicating the size of the object OJ of the time t−1 and an object size value Sn indicating the size of the object OJ of the time t are the same if the imaging distance is kept constant. In other words, the object size value Sn−1 of the time t−1 and the object size value Sn of the time t remain the same if there is no displacement of the medium P in the intersecting direction Z between the time t−1 to the time t.

On the other hand, FIG. 9 illustrates the image data ID when the imaging distance is changing at the time t−1 and the time t, and illustrates the object OJ of the time t−1 (on the right in FIG. 9) and the object OJ of the time t (on the left in FIG. 9) in the image data ID. In particular, FIG. 9 is an example in which the medium P approaches the image sensors 38 and 39 and a current imaging distance of the time t is shorter than a previous imaging distance of the time t−1. In this example, as illustrated in FIG. 9, a current object size value Sn of the time t is larger than a previous object size value Sn−1 of the time t−1. Thus, the object size value Sn increases as the imaging distance decreases, that is, as the medium P comes nearer to the image sensors 38 and 39. On the contrary, if the medium P goes further away from the image sensors 38 and 39 and the current imaging distance of the time t is larger than the previous imaging distance of the time t−1, the current object size value Sn of the time t is smaller than the previous object size value Sn−1 of the time t−1, contrary to FIG. 9. In this way, the object size value Sn increases as the medium P comes nearer to the image sensors 38 and 39.

The controller 50 acquires the displacement amount of the medium P in the intersecting direction Z based on changes in the object size values Sn−1 and Sn per unit time Δt, that is, a difference (Sn−Sn−1) between the previous object size value Sn−1 of the time t−1 and the current object size value Sn of the time t. In addition, when the current object size value Sn of the time t is larger than the previous object size value Sn−1 of the time t−1, the controller 50 determines that the displacement amount per unit time in a direction where the medium P approaches the printing head 16 increases as a difference |Sn−Sn−1| of that time increases. On the other hand, when the current object size value Sn of the time t is smaller than the previous object size value Sn−1 of the time t−1, the controller 50 determines that the displacement amount in a direction where the medium P goes further away from the printing head 16 increases as the difference |Sn−Sn−1| of that time increases.

In addition, the per-unit transported amount An (length of an arrow in FIG. 9) at the time t when the imaging distance is changed so as to be smaller than the specified distance as illustrated in FIG. 9 is larger than the per-unit transported amount An (length of an arrow in FIG. 8) at the time t when the imaging distance is kept at the specified distance as illustrated in FIG. 8. In other words, even when an actual per-unit transported amount that is an amount by which the medium P is transported is constant, a larger per-unit transported amount An is acquired on the surface as the medium P comes nearer to the image sensors 38 and 39. In addition, in a case where the transporting belt 33 is bent further toward a side opposite to a printing head 16 side than the reference surface, a per-unit transported amount An that is smaller than the per-unit transported amount An illustrated in FIG. 8 is acquired. A belt portion of the transporting belt 33, on which the medium P is placed as illustrated in FIG. 3 and the like, is supported by a support frame (not illustrated) from a lower side and the transporting belt 33 curbs on an increase in an amount by which the belt portion is bent toward the side opposite to the printing head 16 side so as to be kept small.

Even when the actual per-unit transported amount of the medium P is constant as such, the per-unit transported amount An further increases and the object size value Sn further increases as the imaging distance between the image sensors 38 and 39 and the medium P decreases. That is because the resolution of the image sensors 38 and 39 changes according to changes in the imaging distance. There is a tendency for the resolution of the image sensors 38 and 39 to further increase as the imaging distance decreases.

Figure 10:
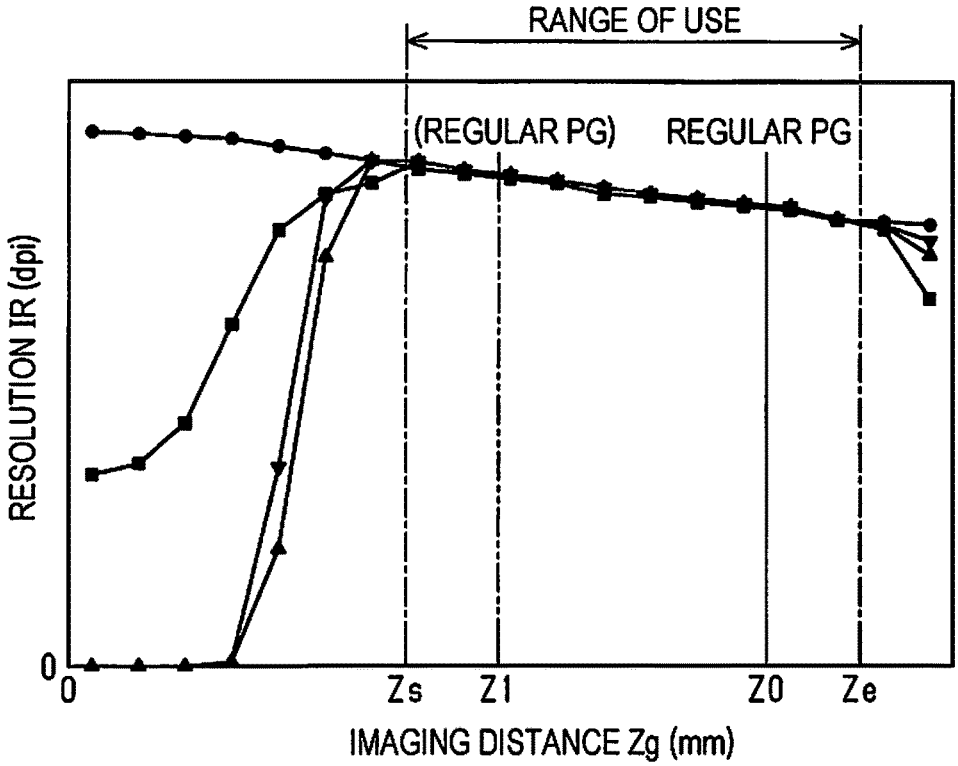
FIG. 10 is a graph illustrating a relationship between an imaging distance and resolution of the image sensor.

FIG. 10 illustrates a relationship between the imaging distance and the resolution of the image sensor. In a graph of FIG. 10, the horizontal axis represents an imaging distance Zg, and the vertical axis represents resolution IR of the image sensor. This graph illustrates a relationship between the imaging distance Zg and the resolution IR for the four types of media P used in the printing apparatus 11. As is apparent from the graph of FIG. 10, a proportional relationship, which is the relationship between the imaging distance Zg and the resolution IR having a substantially constant slope, is established in a range of imaging distances Zs to Ze. In this embodiment, the range of the imaging distances Zs to Ze is set as a range of use for the image sensors 38 and 39. In this range of use, the resolution IR increases at a constant ratio as the value of imaging distance Zg decreases. In this embodiment, the imaging distance at a time of a regular gap PG (=PG0) when the medium P is placed so as to come into close contact with the medium support surface is set to a value Z0 that is close to an upper limit Ze of the imaging distance Zg in the range of use Zs to Ze. Accordingly, the displacement amount of the medium P can be detected in a wide range from the regular gap PG to a side where the medium P can be lifted and the gap PG decrease. At this time, since the value Z0 is set on a side where the imaging distance Zg is slightly smaller than the imaging distance Zg of the upper limit Ze, even the displacement amount of the medium P when, for example, the outer surface of the transporting belt 33 is bent further toward the lower side, which is the side opposite to the printing head 16 side, than the reference surface can be detected.

In a case where the image sensor 39 is disposed at a position on a back surface side of the medium P as marked by the two-dot chain line in FIG. 2 and FIG. 3, the imaging distance at the time of the regular gap PG (=PG0) when the medium P is placed on the medium support surface is set to a value Z1 that is close to a lower limit Zs in the range of use Zs to Ze in the graph of FIG. 10. In addition, a configuration where the image sensor 38 is disposed on the side opposite to the printing head 16 side with respect to the transporting path of the medium P and the image sensor 38 images the back surface, which is a side opposite to the surface to be printed of the medium P, may be adopted. In this case, the image sensor 38 may be disposed such that the imaging distance at the time of regular gap PG is the value Z1.

The controller 50 acquires the object size values Sn−1 and Sn of the object OJ for each unit time in the image obtained by the image sensors 38 and 39 imaging the medium P. Then, the controller 50 acquires the per-unit displacement amount, which is a displacement amount per unit time, based on a difference (Sn−Sn−1) between the previous object size value Sn−1 and the current object size value Sn and adds up the per-unit displacement amounts for each unit time Δt to acquire the displacement amount of the medium P in the intersecting direction Z. Each of a gap changed amount ΔPGn, which is a change amount of gap PG per unit time, and a changed lift amount ΔLUn, which is a change amount per unit time of the lifted amount of the medium P, corresponds to an example of the per-unit displacement amount.

Herein, since the object size value Sn has a directly proportional relationship with the resolution IR, the difference in the object size value Sn and the difference in the imaging distance Zg are in a proportional relationship. When a constant of proportionality is denoted by D (>0), the gap changed amount ΔPGn per unit time is expressed as an equation ΔPGn=D(Sn−Sn−1), and the gap changed amount ΔPG is expressed as an equation ΔPG=ΔPG1+ΔPG2+ . . . +ΔPGn. Then, the present gap PG is expressed as an equation PG=PG0−ΔPG.

In addition, the changed lift amount ΔLUn per unit time is expressed as an equation ΔLUn=D(Sn−Sn−1), and a lifted amount LU (hereinafter, also simply referred to as a "lift amount LU"), which is an example of the present displacement amount of the medium P, is expressed as an equation LU=ΔLU1+ΔLU2+ . . . +ΔLUn.

In addition, the displacement amount of the medium P in the intersecting direction Z can be calculated through the following method. The per-unit transported amount An when the imaging distance is decreased by the medium P approaching the image sensors 38 and 39 is larger than the per-unit transported amount An when the imaging distance is the specified distance. In other words, the per-unit transported amount An increases as the imaging distance decreases. Since this per-unit transported amount An is a transported amount of the medium P per unit time, the per-unit transported amount An is equal to the medium transporting velocity Vp (An=Vp). In addition, if the medium P does not slide on the transporting belt 33, the per-unit transported amount An when the imaging distance is the specified distance is set so as to be equal to a per-unit transported amount Bn, which is the drive amount of the transporting belt 33 per unit time acquired by pulse edges of the encoder signal ES from the encoder 37 being counted. This per-unit transported amount Bn is equal to the transport drive velocity Vd (Bn=Vd).

For this reason, a difference (=An−Bn) between the per-unit transported amount An and the per-unit transported amount Bn has a constant relationship with the displacement amount of the medium P in the intersecting direction Z. For this reason, when the constant of proportionality is denoted by K (>0), the gap changed amount ΔPG is expressed as ΔPG=K(An−Bn), and the present gap PG is expressed as PG=PG0−K(An−Bn). The present gap PG can also be expressed as Equation PG=PG0−K(Vp−Vd). In addition, the lift amount LU is expressed as Equation LU=K(An−Bn).

The lift amount LU can also be expressed as LU=K(Vp−Vd). In this embodiment, the medium transporting velocity Vp(=An) corresponds to an example of a first transport velocity, and the transport drive velocity Vd (=Bn) corresponds to an example of a second transport velocity.

Then, if the per-unit transported amount An is larger than the per-unit transported amount Bn, that is, if the medium transporting velocity Vp is higher than the transport drive velocity Vd, the controller 50 determines that the medium P is displaced in the direction of approaching the image sensors 38 and 39. In addition, if the per-unit transported amount An is smaller than the per-unit transported amount Bn, that is, if the medium transporting velocity Vp is lower than the transport drive velocity Vd, the controller 50 determines that the medium P is displaced in the direction of going further away from the image sensors 38 and 39.

Figure 12:
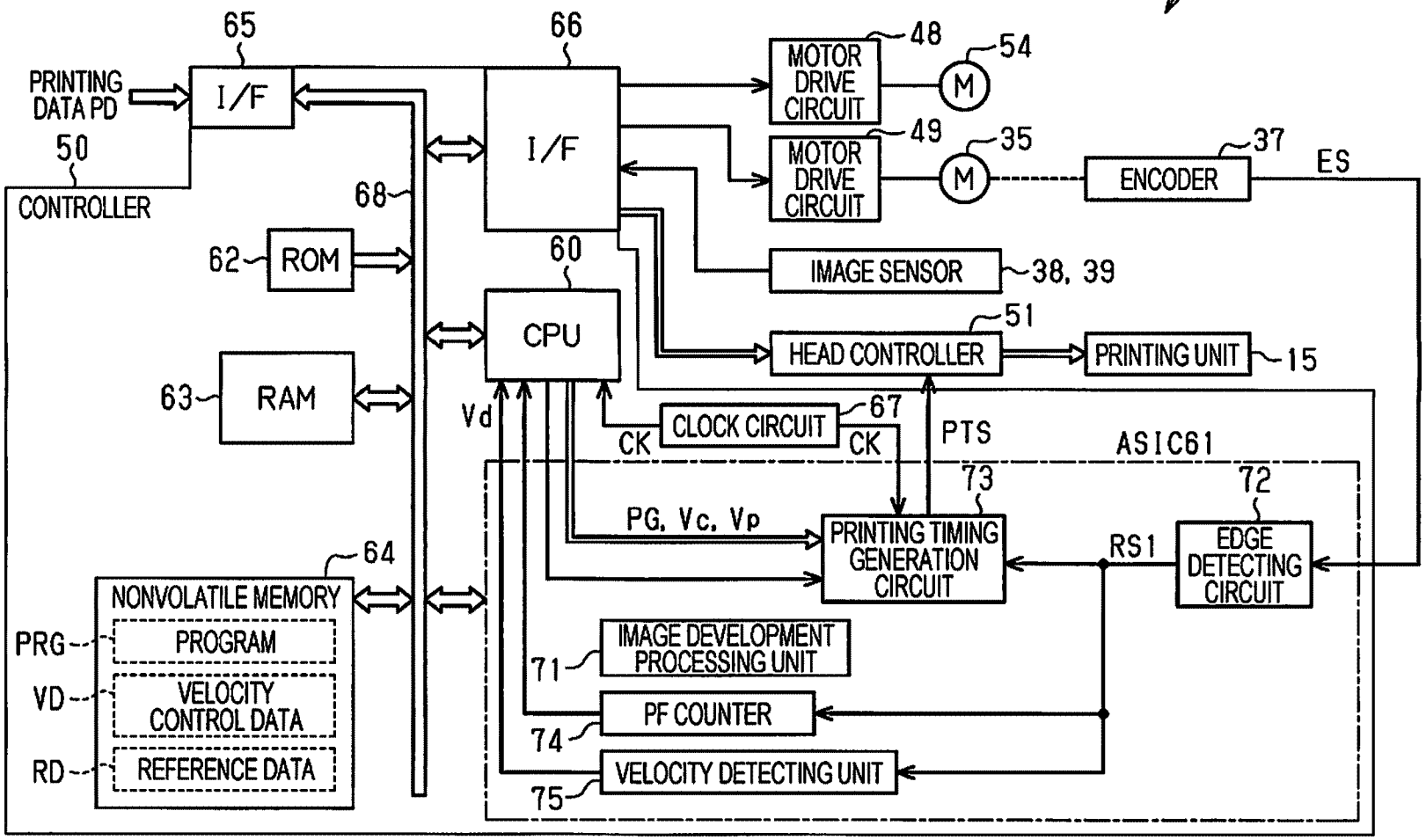
FIG. 12 is a block diagram illustrating an electrical configuration of the printing apparatus.

Hereinafter, an electrical configuration of the printing apparatus 11 will be described with reference to FIG. 12. As illustrated in FIG. 12, the printing apparatus 11 is provided with the controller 50, the head controller 51, and motor drive circuits 48 and 49. In addition, the printing apparatus 11 is provided with the aforementioned encoder 37 and the image sensors 38 and 39, which are input systems. The controller 50 drives the transporting device 14 to feed and transport the medium P by controlling the transporting motor 35 and the like via the motor drive circuit 49 in accordance with a predetermined velocity profile so as to be driven at the drive velocity accompanying acceleration, constant velocity, and deceleration. In addition, the controller 50 causes the electric motor 54 to be forward rotation-driven or reverse rotation-driven via the motor drive circuit 48 to drive the gap adjusting device 52, and then the printing unit 15 is raised or lowered, thereby adjusting the gap between the printing head 16 and the medium P. In a state of being electrostatically adsorbed onto the transporting belt 33, the medium P sent to the transporting mechanism 30 is transported at a constant transporting velocity with the regular gap PG0 being provided between the medium P and the printing head 16 after the gap adjustment.

In addition, based on the printing data PD input, for example, from the host device (not illustrated), the controller 50 controls and drives the printing head 16 (specifically, the discharge drive element 163 mounted in each nozzle) so as to be driven via the head controller 51.

The controller 50 is provided with a central processing unit (CPU) 60, an Application Specific Integrated Circuit (ASIC) 61, which is a custom LSI, a ROM 62, a RAM 63, a nonvolatile memory 64, an input interface 65, an input and output interface 66, and a clock circuit 67. The CPU 60, the ASIC 61, the ROM 62, the RAM 63, the nonvolatile memory 64, the input interface 65, and the input and output interface 66 are connected to each other via a bus 68.

The input interface 65 illustrated in FIG. 12 receives the printing data PD transmitted through a wired or wireless communication, for example, from the host device (not illustrated) and inputs the data to the printing apparatus 11. The input printing data PD is stored in the RAM 63.

Various control programs and various types of data are stored in the ROM 62. Various programs PRG, such as printing control programs (firmware programs), and various types of data required for printing processing, including velocity control data VD used when controlling the velocity of the transporting motor 35 and reference data RD, are stored in the nonvolatile memory 64. The programs PRG include each program for printing head control (refer to FIG. 16) including printing head 16 discharge timing correction processing, head scratching avoidance control (refer to FIG. 16) for avoiding the scratching of the printing head 16 by the medium P, and jam avoidance control (refer to FIG. 19) for avoiding the medium P jam. In addition, each of these programs includes measurement processing (FIG. 14, FIG. 15, FIG. 17, and FIG. 18) in which the displacement amount of the medium P in the intersecting direction Z (lifted direction) that intersects the surface to be printed of the medium P is measured. In addition, the reference data RD is stored in the nonvolatile memory 64. The reference data RD is referred to when acquiring the displacement amount of the medium P in the intersecting direction Z based on the object size value Sn or the per-unit transported amounts An (=Vp) and Bn (=Vd) acquired, which are based on the plurality of images obtained by the image sensors 38 and 39 imaging the medium P at different times. The reference data RD consist of a formula or table data.

A program executed by the CPU 60, various types of data, which are arithmetic operation results and processing results of the CPU 60, and various data processed by the ASIC 61 are temporarily stored in the RAM 63.

In addition, the printing data PD and intermediate data, which is obtained in the middle of generating discharge data from the printing data PD, are stored in the RAM 63. The discharge data is formed of a collection of data obtained by collecting one dot data, which is a predetermined shade value for causing the printing head 16 to discharge the ink droplets once from the nozzle 161, for each nozzle line (for each color).

The CPU 60 analyzes (interprets) a command included in the printing data PD, which is written in a printing language. The ASIC 61 is provided with an image development processing unit 71, which converts an intermediate code in the printing data PD into bitmap data in which a pixel corresponding to a print dot is indicated in a predetermined shade to develop on the RAM 63, and a drive signal generation circuit (not illustrated). Then, the developed bitmap data is output by the discharge data, which is a predetermined transmission unit, from the input and output interface 66 to the printing unit 15 via the head controller 51. The head drive circuit 55 (refer to FIG. 13) in the printing unit 15 controls the discharging of the printing head 16 by selecting, based on the discharge data, whether or not to apply the drive pulse, which is included in a drive signal input from the drive signal generation circuit (not illustrated) in the ASIC 61, to the discharge drive element 163 for each timing based on the printing timing signal PTS.

In the controller 50, the encoder 37, which outputs the encoder signal ES including the number of nozzles proportional to the rotation amount of the roller 31 that is rotation-driven by the transporting motor 35, and the image sensors 38 and 39 are electrically connected to each other as the input systems.

In addition, the ASIC 61 illustrated in FIG. 12 performs processing of generating the printing timing signal PTS and processing of acquiring a control value required for transporting control as well as image development processing. For this reason, in addition to the image development processing unit 71, the ASIC 61 is provided with an edge detecting circuit 72 used in generating the printing timing signal PTS, a printing timing generation circuit 73, a PF counter 74 that acquires the control value required for transporting control, and a velocity detecting unit 75. The edge detecting circuit 72 generates a pulse each time the pulse edge of the encoder signal ES input from the encoder 37 is detected and outputs a reference pulse signal RS1 which has the same cycle as that of the encoder signal ES.

This reference pulse signal RS1 is output to the printing timing generation circuit 73, the PF counter 74, and the velocity detecting unit 75.

The printing timing generation circuit 73 performs signal generation processing using the reference pulse signal RS1 input from the edge detecting circuit 72, a clock signal CK input from the clock circuit 67, and the like to generate the printing timing signal PTS. The signal generation processing performed by the printing timing generation circuit 73 includes cycle division processing (multiplication processing) of generating reference timing signals PRS (refer to FIG. 11) of a plurality of pulse cycles obtained by dividing (multiplying) one cycle of the reference pulse signal RS1 and delay processing of generating the printing timing signal PTS by delaying this reference timing signal PRS for a length of time according to a delay value Dp. The printing timing signal PTS generated by the printing timing generation circuit 73 is output to the printing unit 15 via the head controller 51.

The PF counter 74 counts, for example, the pulse edges of the reference pulse signal RS1 input from the edge detecting circuit 72 to acquire a transporting position y, with a drive initiation position of the transporting motor 35 being set as the origin, from the obtained count value. This transporting position y is used in the control of the velocity of the transporting motor 35, which is executed with reference to the velocity control data VD illustrated in FIG. 12.

In addition, the printing timing generation circuit 73 illustrated in FIG. 12 inputs, from the CPU 60, the gap PG, a target transporting velocity Vc, the medium transporting velocity Vp, and the like, which are parameters required for determining the delay value Dp that determines output timing of the printing timing signal PTS.

Figure 13:
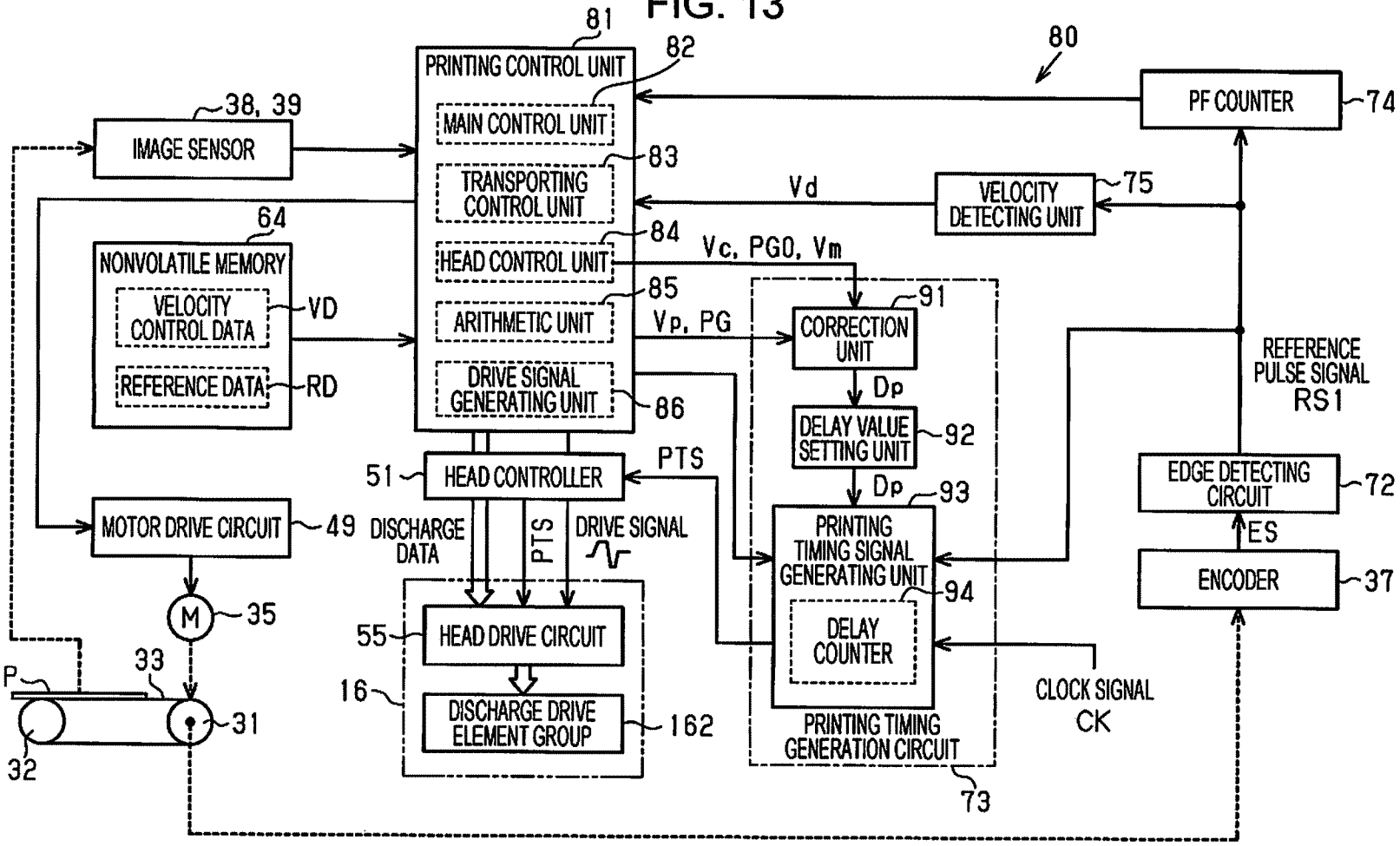
FIG. 13 is a block diagram illustrating an electrical configuration of a discharge control device.

The printing apparatus 11 is provided with a discharge control device 80 illustrated in FIG. 13. The printing apparatus 11 is provided with a printing control unit 81 illustrated in FIG. 13, which has various functional units constructed by the programs PRG being executed by the CPU 60 illustrated in FIG. 12. As illustrated in FIG. 13, the printing control unit 81 is provided with a main control unit 82, a transporting control unit 83, a head control unit 84, and a drive signal generating unit 86, as functional units. The main control unit 82 handles various controls, including the drive control of the transporting motor 35 and the discharge timing control of the printing head 16 by giving instructions to each of the units 83, 84, and 86.

The transporting control unit 83 acquires the target transporting velocity Vc (constant velocity) according to the printing mode and acquires the velocity control data VD from which the target transporting velocity Vc is obtained. The transporting control unit 83 performs a feedback control in which an actual velocity of the transporting motor 35 is caused to approach a target velocity acquired with reference to the velocity control data VD. Accordingly, the transporting control unit 83 drives the pair of feeding rollers 42 and the transporting belt 33 at a constant velocity according to the printing mode to transport the medium P at a constant transporting velocity.

The head control unit 84 performs a discharge control in which the ink droplets are discharged from the nozzles 161 of the plurality of discharging units 164 provided in the printing head 16. The head control unit 84 outputs the discharge data generated by the printing data PD being developed by the image development processing unit 71 (refer to FIG. 12) to the head drive circuit 55 via the head controller 51. In addition, the head control unit 84 outputs a delay reference value Ds, which is a reference when correcting the discharge timing, to the printing timing generation circuit 73. The delay reference value Ds is a delay value which is set such that the discharge timing becomes appropriate when the transporting belt 33 is at the target transporting velocity Vc (constant velocity) and the gap PG is the regular gap PG0. This delay reference value Ds is set for each target transporting velocity Vc according to the printing mode and for each regular gap PG0 according to the medium type.

The drive signal generating unit 86 generates a plurality of types (for example, three types or four types) of drive pulses for each discharge cycle (one cycle), in which the ink is discharged from the nozzle 161 so as to form one dot, to output to the head drive circuit 55. The printing head 16 is capable of discharging the plurality of sizes of ink droplets, and is capable of discharging, for example, three levels of sizes, including large, medium, and small, of ink droplets. The dischargeable size of the ink droplets may be one level or may be two levels or five or more levels.

The head drive circuit 55 inputs the discharge data, the drive signal, and the printing timing signal PTS. The head drive circuit 55 selects one type or two types of drive pulses according to the shade value for each pixel of the input discharge data out of a plurality of drive pulses included in the input drive signal, and applies the selected drive pulse to each discharge drive element 163 (refer to FIG. 6) at timing based on the printing timing signal PTS. Accordingly, the head drive circuit 55 controls the selection of discharge or non-discharge of the ink droplets and the size of the ink droplets to be discharged for each discharge drive element 163 of the discharge drive element group 162.

In addition, the velocity detecting unit 75 illustrated in FIG. 13 measures a cycle T of the reference pulse signal RS1 by, for example, the pulse edges of the input clock signal CK being counted in a period of one cycle of the reference pulse signal RS1 input from the edge detecting circuit 72 and outputs the reciprocal of the cycle T as the transport drive velocity Vd (=Bn) to the printing control unit 81.

As illustrated in FIG. 13, the printing timing generation circuit 73 is provided with a correction unit 91, a delay value setting unit 92, and a printing timing signal generating unit 93. The correction unit 91 calculates the delay value Dp based on various parameters Vp, PG, Vc, PG0, and Vm acquired from the printing control unit 81 and sets the delay value Dp in the delay value setting unit 92. The printing timing signal generating unit 93 sets the delay value Dp read from the delay value setting unit 92 in a delay counter 94. Then, the printing timing signal generating unit 93 outputs the printing timing signal PTS to the head controller 51 once the delay counter 94 completes the counting of the delay value Dp.

Figure 11:
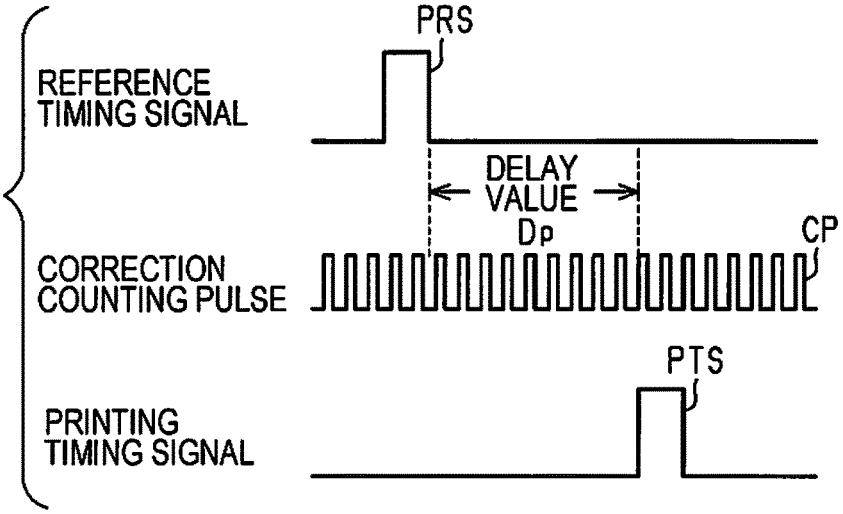
FIG. 11 is a signal wave form view illustrating a method for generating a printing timing signal.

Hereinafter, the generation of the printing timing signal PTS performed by the printing timing generation circuit 73 will be described with reference to FIG. 11 and FIG. 13. The printing control unit 81 in the controller 50, which is illustrated in FIG. 13, acquires the per-unit transported amount An (medium transporting velocity Vp) of the medium P and the object size value Sn for each unit time based on the detection signals Sy and Ss from the image sensor 39. In a case where the gap PG is measured without using the encoder 37, an arithmetic unit 85 calculates the current gap changed amount ΔPGn (=D(Sn−Sn−1)) for each unit time based on the previous object size value Sn−1 and the current object size value Sn. Then, the arithmetic unit 85 calculates the gap changed amount ΔPG with respect to the regular gap PG0 by accumulating the gap changed amounts ΔPGn for each time. In this example, it is considered that the gap PG is the regular gap PG0 (gap changed amount ΔPG=0) at an initial time (n=1) when the image sensors 38 and 39 detect the leading end of the medium P. For this reason, the arithmetic unit 85 calculates the gap PG through an equation PG=PG0+ΔPG. On the other hand, in a case where the gap PG is measured using the encoder 37, the arithmetic unit 85 calculates the gap PG through an equation PG=PG0+K(An−Bn) using the per-unit transported amount Bn (transport drive velocity Vd) based on the encoder signal ES.

The head control unit 84 gives each piece information of the medium transporting velocity Vp, the gap PG, and the target transporting velocity Vc to the correction unit 91. The correction unit 91 calculates the delay value Dp through the following equation using each parameter of the medium transporting velocity Vp, the gap PG, the target transporting velocity Vc, and the ink discharge velocity Vm.

$$Dp=Ds+\{(PG0-PG)/Vm\}\cdot(Vc-Vp) \quad (1)$$

Herein, the PG0 is a regular gap determined according to the printing mode and the medium type. In addition, Ds denotes a reference delay value, and this value is a delay value at which the ink droplets discharged from the printing head 16 can be landed at the target position when the present gap PG coincides with the regular gap PG0 and the medium transporting velocity Vp coincides with the target transporting velocity Vc.

The correction unit 91 sets the delay value Dp acquired through the above Equation (1) in the delay value setting unit 92. For example, a register (not illustrated) is provided in the delay value setting unit 92, and the delay value Dp set by the correction unit 91 is stored in the register. Instead of the above Equation (1), the delay value Dp may be calculated using other formulas.

The printing timing signal generating unit 93 illustrated in FIG. 13 inputs the reference pulse signal RS1, the clock signal CK from the clock circuit 67 (refer to FIG. 12), and the delay value Dp from the delay value setting unit 92. The printing timing signal generating unit 93 multiplies the reference pulse signal RS1 and generates the reference timing signal PRS, which is illustrated in FIG. 11, having the same pulse cycle as that of the printing timing signal PTS and a correction counting pulse CP which is illustrated in FIG. 11 and of which the pulse cycle is sufficiently shorter than that of the reference timing signal PRS.

The printing timing signal generating unit 93 illustrated in FIG. 13 is provided with the delay counter 94 for measuring delay time based on the delay value Dp. The delay value Dp is set as a target value in the delay counter 94. In addition, the reference timing signal PRS and the correction counting pulse CP are input in the delay counter 94. As illustrated in FIG. 11, with the pulse of the reference timing signal PRS being set as a trigger, the delay counter 94 initiates counting the number of the correction counting pulses CP and counts down from the counted value. Once the time corresponding to the delay value Dp elapses and the counted value becomes "0", the delay counter 94 outputs the printing timing signal PTS. In other words, the printing timing signal generating unit 93 generates the printing timing signal PTS by the pulse of the reference timing signal PRS being output at the timing delayed for a length of time equivalent to the delay value Dp.

Hereinafter, the operation of the printing apparatus 11 will be described. Once a printing job is received, the printing control unit 81 illustrated in FIG. 13 reads, from the non-volatile memory 64, the velocity control data VD corresponding to the target transporting velocity Vc (constant velocity) determined from a designated printing mode of that time. In addition, the printing control unit 81 acquires the regular gap PG0 corresponding to information of the printing mode and the medium type (for example, sheet type) and drives the gap adjusting device 52, if necessary, to adjust the interval between the printing head 16 and the medium P so as to become the regular gap PG0. The printing control unit 81 controls the velocity of the transporting motor 35 with reference to the velocity control data VD determined from the printing mode to transport the medium P fed from the cassette 12*c* or the feeding tray 12F onto the transporting belt 33 of the transporting mechanism 30 through the pair of feeding rollers 42. The medium P is transported in a state where the regular gap PG0 between the medium P and the printing head 16 is secured below the printing unit 15 by the transporting belt 33 being rotated.

Figure 14:
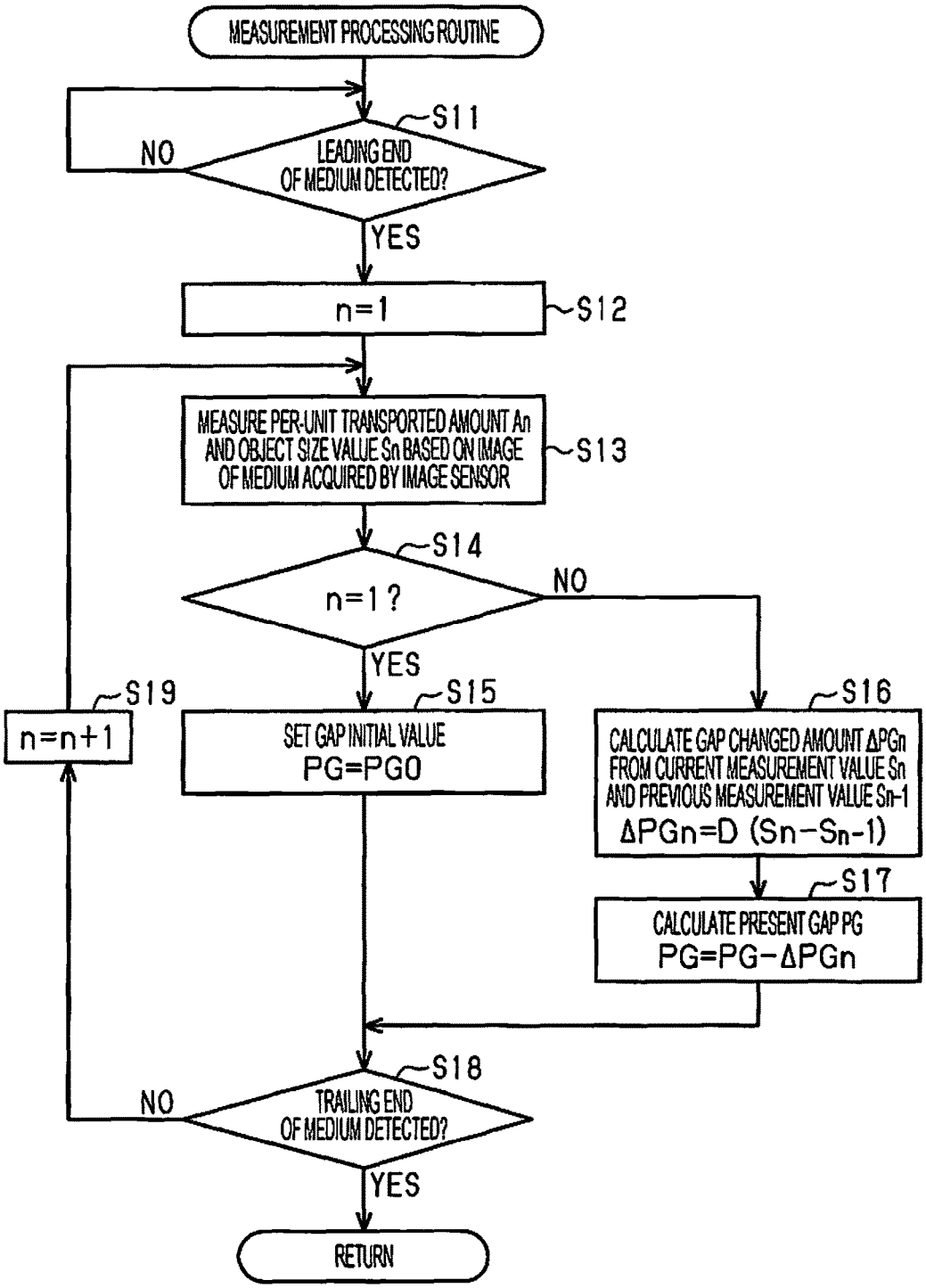
FIG. 14 is a flow chart illustrating a measurement processing routine.
Figure 15:
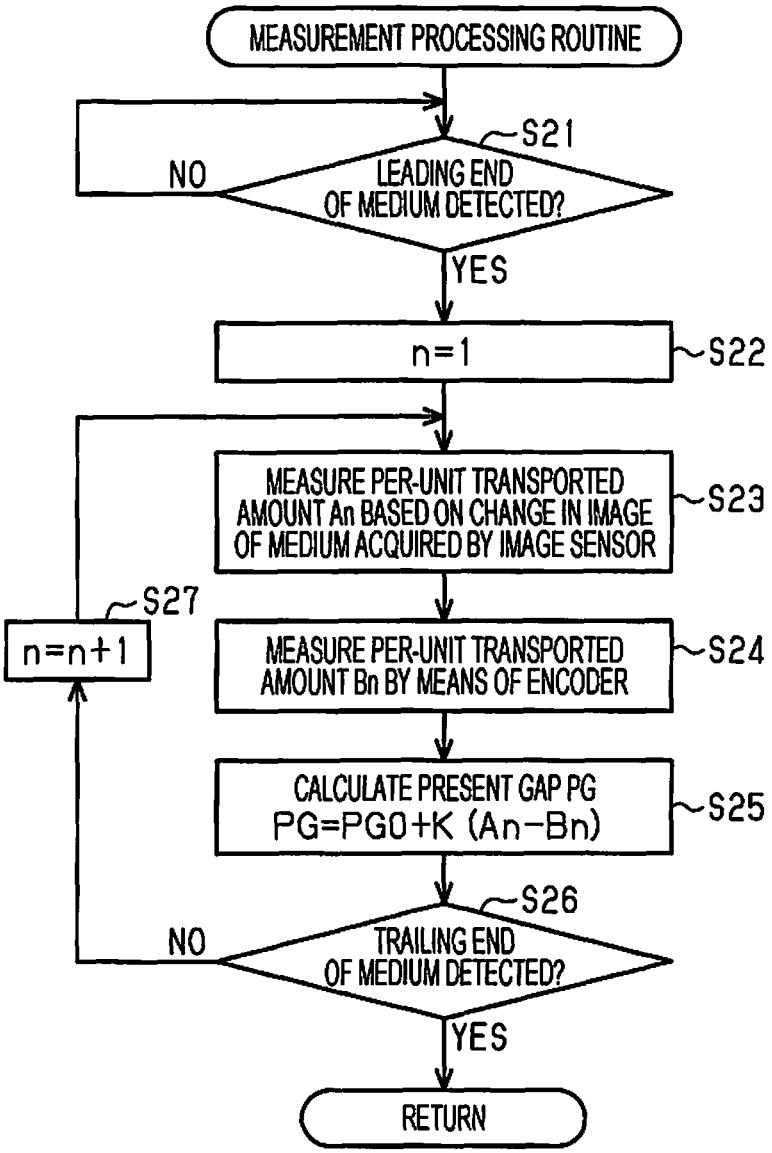
FIG. 15 is a flow chart illustrating a measurement processing routine different from that of FIG. 14.
Figure 16:
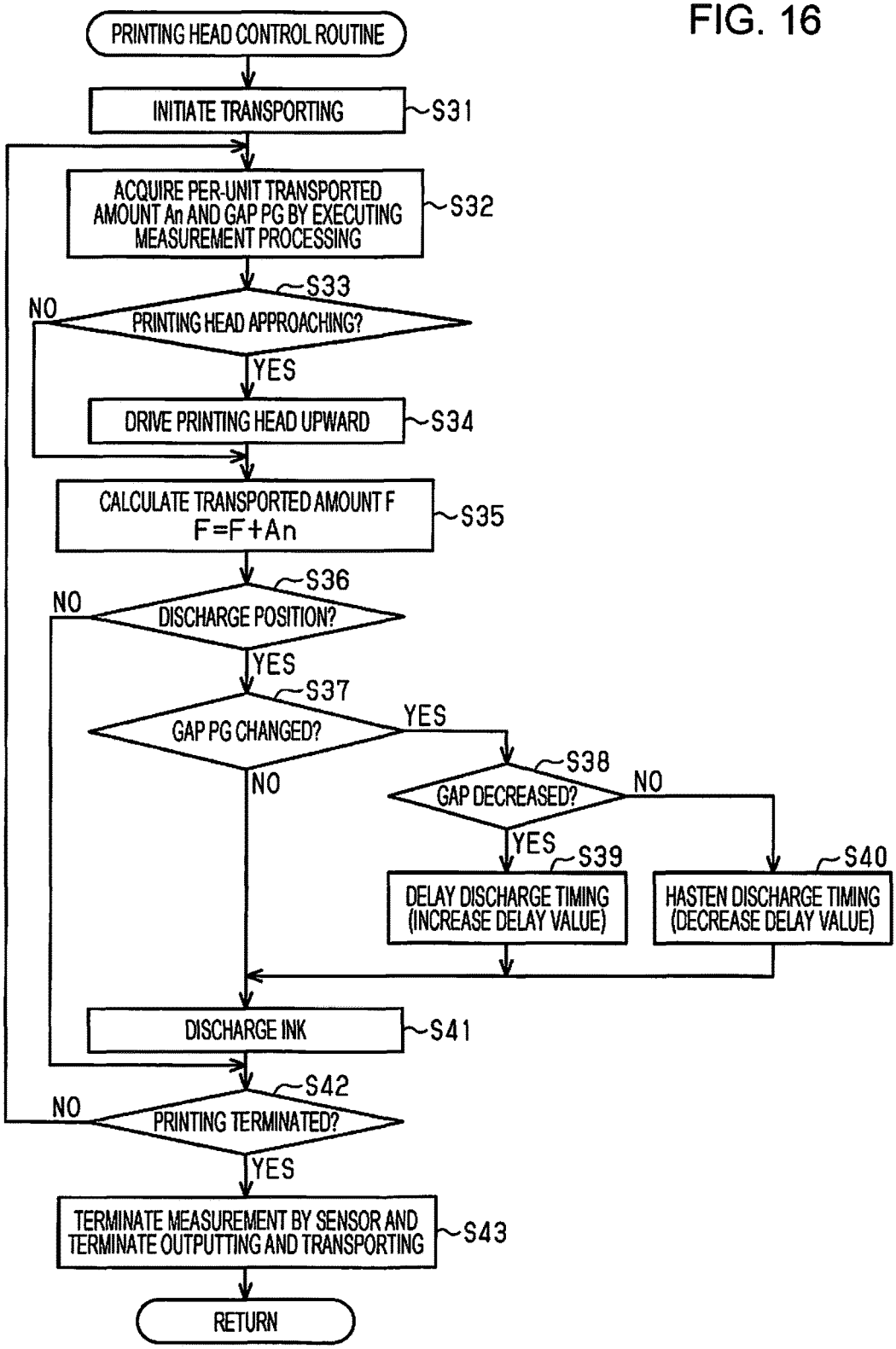
FIG. 16 is a flow chart illustrating a printing head control routine.
Figure 17:
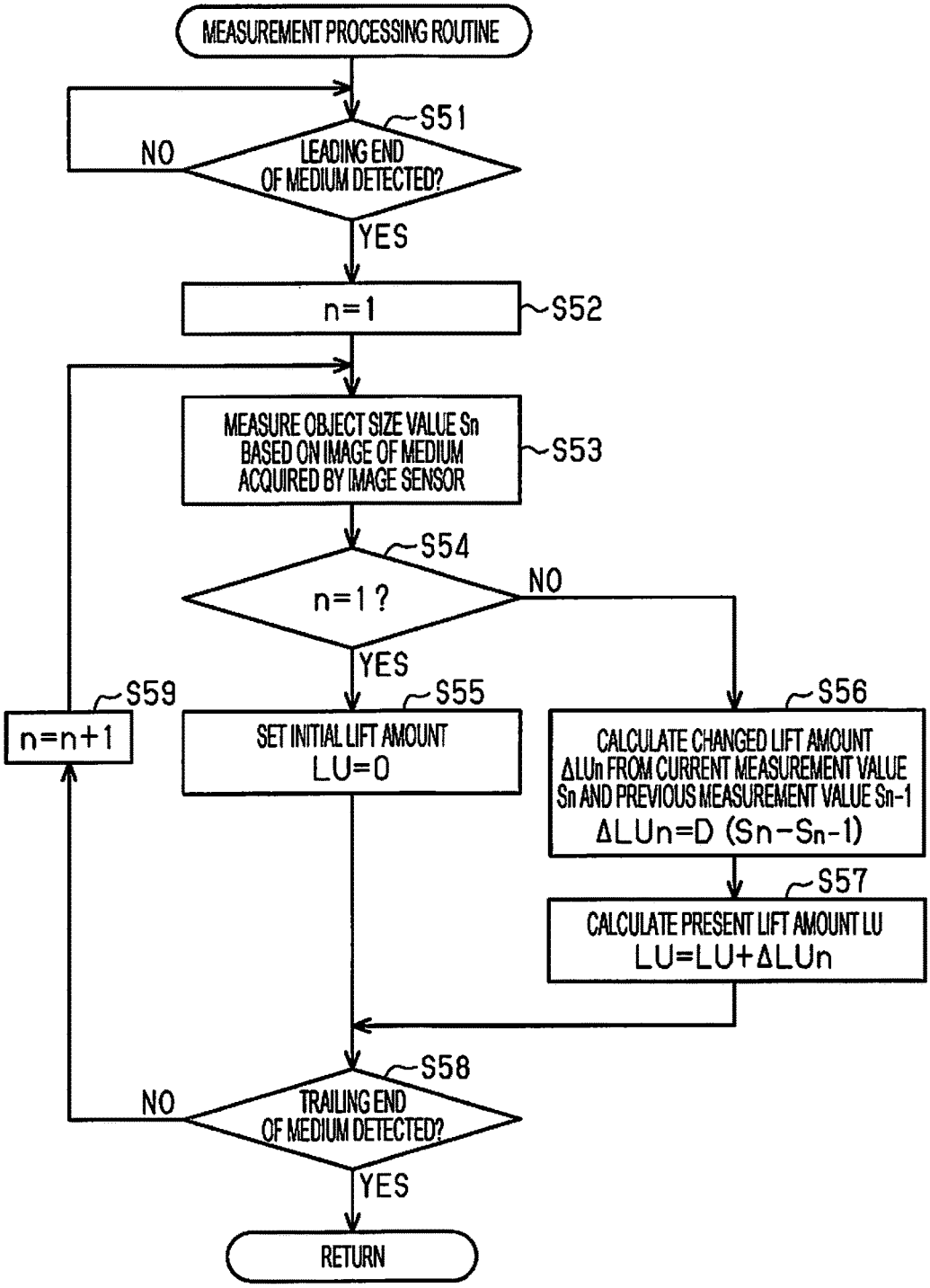
FIG. 17 is a flow chart illustrating a measurement processing routine.
Figure 18:
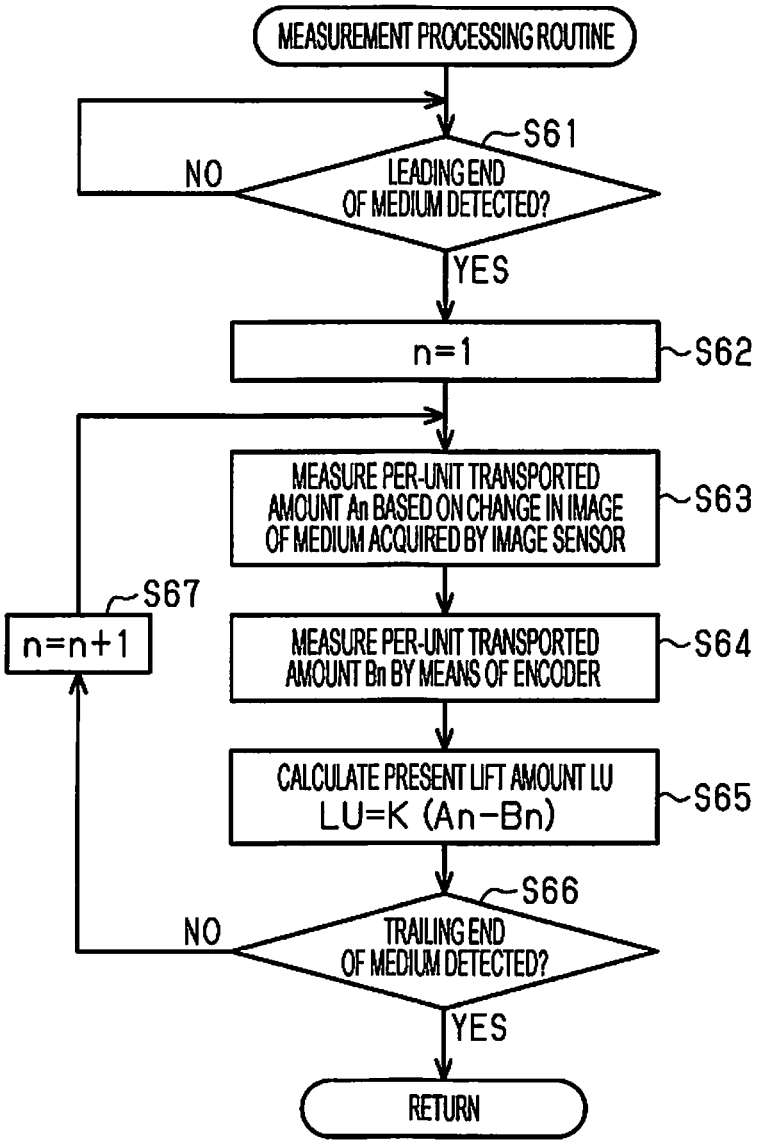
FIG. 18 is a flow chart illustrating a measurement processing routine different from that of FIG. 17.
Figure 19:
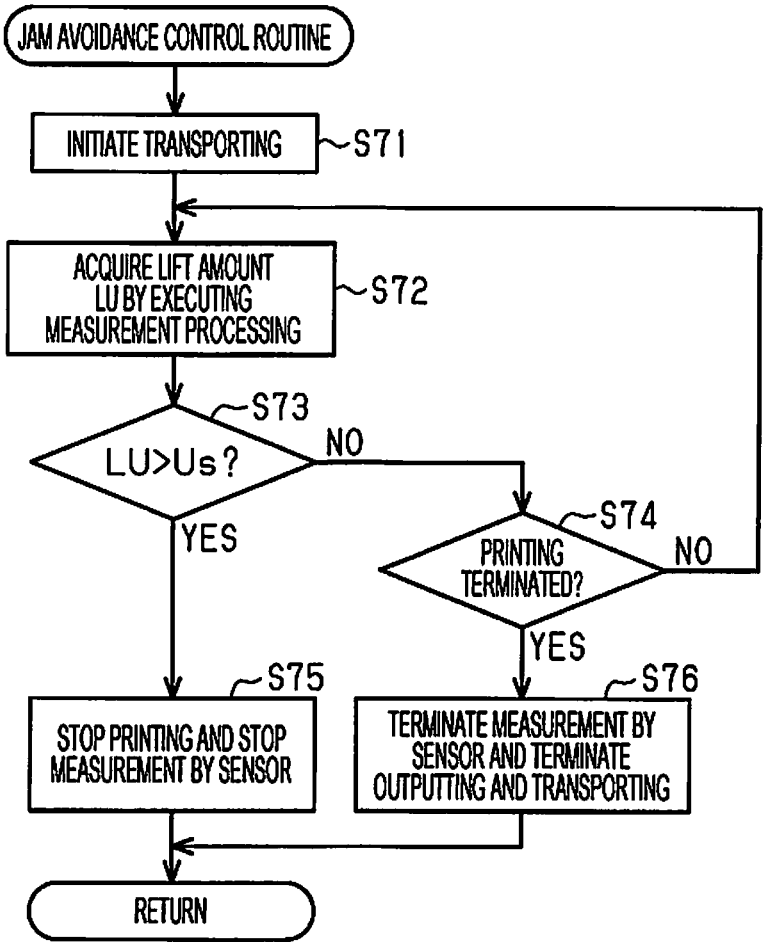
FIG. 19 is a flow chart illustrating a jam avoidance control routine.

Once the feeding of the medium P is initiated, the controller 50 executes programs PRG for a printing head control routine illustrated in FIG. 16 and a jam avoidance control routine illustrated in FIG. 19. In the printing head control routine, a measurement processing routine illustrated in FIG. 14 or FIG. 15 is executed, and in the jam avoidance control routine, the measurement processing routine illustrated in FIG. 17 or FIG. 18 is executed. Then, the controller 50 sequentially acquires the image of the medium P imaged by the image sensors 38 and 39 in each measurement processing routine.

Hereinafter, a printing control executed by the controller 50 will be described in detail with reference to FIG. 14 to FIG. 19. First, the measurement processing routine in which the displacement amount of the medium P in the intersecting direction Z is measured will be described with reference to FIG. 14 and FIG. 15. Herein, in the measurement processing of the displacement amount, two ways illustrated in FIG. 14 and FIG. 15 are prepared. First of all, the measurement processing routine in which the encoder 37 is not used will be described with reference to FIG. 14.

First, in Step S11, it is determined that whether or not the leading end of the medium is detected. Based on the acquired image, the controller 50 determines whether or not the medium is included in the image. The bottom portion of the transporting path, such as the transporting belt 33 which transports the medium P, is in dark color that is different from that of the medium P, which is in white-based light color, in terms of brightness. For this reason, the leading end of the medium can be detected from the difference in the brightness of the image captured by the image sensor 39. Once the leading end of the medium is detected, processing proceeds to Step S12, and if the leading end of the medium is not detected, processing of Step S11 is repeated until the leading end is detected.

In Step S12, n is set to 1. That is, the measurement processing is performed for each unit time from a time point when the leading end of the medium P is detected, and an initial value of n, which is a value indicating the number of times the measurement processing is to be performed, is set.

In the next Step S13, the per-unit transported amount An and the object size value Sn are measured based on the image of the medium acquired by the image sensor. That is, the per-unit transported amount An is measured based on a change in the image of the medium acquired by the image sensor 39. The per-unit transported amount An, which is the movement amount of the medium P in the transporting direction Y per unit time, is acquired by calculating a difference between a y coordinate of the object OJ in the previous image of the time t−1 and a y coordinate of the object OJ in the current image of the time t. In this example, the per-unit transported amount An is acquired from the detection signal Sy output by the image sensor 39. In addition, the size (object size value Sn) of the object OJ in the image is acquired based on the image of the medium P acquired by the image sensor 39. In a case where the medium P is displaced in the intersecting direction Z, this object size value Sn increases or decreases in a direction where the displacement has occurred by an amount according to the displacement amount. In this example, the object size value Sn is acquired from the detection signal Ss output by the image sensor 39. Herein, the object OJ is selected as the minute region having a predetermined shape (rectangular shape or circular shape) at a position set in advance close to the upstream side in the transporting direction Y in an imaging region of the medium P. Specifically, an uneven pattern of the outer surface of the medium in the minute region is set as the object OJ. The acquired per-unit transported amount An and the object size value Sn are saved in the memory unit including the RAM and the register. The arithmetic unit 85 of the controller 50 may sequentially acquire the captured image of the medium from the image sensor 39, and calculate the per-unit transported amount An and the object size value Sn based on a change between the previous and the current images.

In the next Step S14, it is determined that whether or not n is 1. If n is 1, processing proceeds to Step S15, and if n is not 1, that is, at a time of the second and subsequent measurement processing, processing proceeds to Step S16.

In Step S15, a gap initial value is set. The controller 50 acquires the regular gap PG0 determined according to the medium type of the medium P of that time and sets the regular gap PG0 as an initial value of the gap PG (PG=PG0). Herein, it is considered that the lift amount is "0 (zero)" at a time of n=1 when the leading end of the medium P is detected, and the regular gap PG0 is set as the gap initial value.

In Step S16, a gap changed amount ΔPGn is calculated from the current measurement value Sn and the previous measurement value Sn−1. The gap changed amount ΔPGn is calculated through an equation ΔPGn=D(Sn-Sn−1). Herein, D is the constant of proportionality determined from the slope in the range of use within the graph illustrating the relationship between the imaging distance and the resolution illustrated in FIG. 10.

In Step S17, the present gap PG is calculated. That is, the present gap PG is calculated through an equation PG=PG+ΔPGn. For example, if n is 2, PG=PG0+ΔPG1 is calculated, and the current gap changed amount ΔPGn is added to the previous gap PG. For this reason, since the current gap changed amount ΔPGn (however, n=1, 2, 3, . . . ) is added to the previous gap PG for each time, the gap PG is equal to a value obtained by adding an accumulated value of the gap changed amount ΔPGn (however, n=1, 2, 3, . . . ) to the gap initial value (regular gap PG0). The gap PG is saved in the memory unit including the RAM and the register.

In Step S18, it is determined that whether or not a trailing end of the medium is detected. The controller 50 detects the trailing end of the medium P based on a brightness difference in the acquired image. If the trailing end of the medium P is not detected, processing returns to Step S13 after an increment of "n" is made in Step S19 (n=n+1). On the other hand, if the trailing end of the medium P is detected, this routine is terminated. Hereinafter, processing of Steps S13 to S19 is repeated until the trailing end of the medium P is detected (determined to be affirmative in S18). As a result, the present gap PG saved in the memory unit is updated for each unit time. Thus, in a period from the detection of the leading end of the medium P by the image sensor 39 to the detection of the trailing end, the gap PG of each time is acquired.

Hereinafter, the measurement processing routine in which the encoder 37 is used will be described with reference to FIG. 15.

First, in Step S21, it is determined that whether or not the leading end of the medium is detected. This processing is the same as the processing of Step S11 in FIG. 14. The controller 50 stands by until the leading end of the medium P is detected by the image sensor 39, and processing proceeds to Step S22 once the leading end of the medium P is detected.

In Step S22, n is set to 1. That is, from a time point at which the leading end of the medium P is detected, the subsequent measurement processing is performed for each unit time, and an initial value of n, which is a value indicating the number of times the measurement processing is to be performed, is set.

In Step S23, the per-unit transported amount An is measured based on a change in the image of the medium acquired by the image sensor. This processing is the same as the processing of measuring the per-unit transported amount An in Step S13 of FIG. 14. In a case where the medium P is displaced in the intersecting direction Z, this per-unit transported amount An increases or decreases with respect to the actual per-unit transported amount of the medium. This per-unit transported amount An is saved in the memory unit. The per-unit transported amount An is equal to the medium transporting velocity Vp.

In the next Step S24, the per-unit transported amount Bn is measured by the encoder. That is, the velocity detecting unit 75 of the controller 50 inputs the reference pulse signal RS1 generated in the same pulse cycle based on the encoder signal ES from the encoder 37 and acquires the per-unit transported amount Bn from the counted value per unit time obtained by counting the pulse edges of this reference pulse signal RS1. This per-unit transported amount Bn is equal to the transport drive velocity Vd, which is a drive velocity of a transport system including the transporting belt 33. For example, the per-unit transported amount An (medium transporting velocity Vp) is basically equal to the per-unit transported amount Bn (transport drive velocity Vd) if the medium P does not slide on the transporting belt 33, the transport drive velocity Vd is the same as the medium transporting velocity Vp, and the gap is kept at the regular gap PG0. On the other hand, since the sliding of the medium P is unlikely to occur when the transporting belt 33 is driven at a constant drive velocity, it can be considered that the transport drive velocity Vd is the same as the medium transporting velocity Vp. Once the gap PG changes in this state, the per-unit transported amount An (medium transporting velocity Vp) basically becomes inconsistent with the per-unit transported amount Bn (transport drive velocity Vd). In other words, it can be considered that the inconsistency between the per-unit transported amount An and the per-unit transported amount Bn is due to the change in the gap PG. This per-unit transported amount Bn is saved in the memory unit.

In Step S25, the present gap PG is calculated. That is, the arithmetic unit 85 of the controller 50 calculates the present gap PG through an equation PG=PG0+K(An−Bn). Herein, K denotes the constant of proportionality determined from the slope in the range of use within the graph illustrating the relationship between the imaging distance and the resolution illustrated in FIG. 10. The calculated gap PG is saved in the memory unit.

In Step S26, it is determined that whether or not the trailing end of the medium is detected. The controller 50 detects the trailing end of the medium based on the brightness difference in the image captured by the image sensor 39. If the trailing end of the medium is not detected, processing returns to Step S23 after an increment of "n" is made (n=n+1) in Step S27. On the other hand, if the trailing end of the medium is detected, this routine is terminated. Hereinafter, processing of Steps S23 to S27 is repeated until the trailing end of the medium is detected (determined to be affirmative in S26). As a result, the present gap PG saved in the memory unit is updated for each unit time. Thus, in a period from the detection of the leading end of the medium P by the image sensor 39 to the detection of the trailing end, the gap PG of each time is acquired.

Hereinafter, the printing head control routine performed using the per-unit transported amount An and the gap PG that are obtained in the measurement processing of FIG. 14 or FIG. 15 will be described with reference to FIG. 16. This printing head control includes a printing head scratching prevention control of preventing the lifted medium P from scratching the nozzle opening surface 16*a* of the printing head 16 and a discharge timing correction control of correcting ink discharge timing of the printing head 16 to avoid the landing position deviation of ink droplets attributable to a decrease in the gap PG as a result of the lifted medium P.

First, in Step S31, transporting the medium is initiated. That is, the controller 50 drives the transporting motor 35 to feed the medium P from the cassette 12*c* or the feeding tray 12F. The fed medium P is passed on to the transporting belt 33 of the transporting mechanism 30 through the pair of feeding rollers 42 and is transported in a state of being electrostatically adsorbed onto the rotating transporting belt 33.

In Step S32, the per-unit transported amount An and the gap PG are acquired by executing the measurement processing.

This measurement processing is performed by executing the measurement processing routine illustrated in the aforementioned FIG. 14 or FIG. 15. As a result of this measurement processing, the per-unit transported amount An and the present gap PG are acquired based on the image of the medium P imaged by the image sensor 39. For example, in a case where the medium P is curled or the electrostatic adsorption force of the transporting belt 33 is weakened for some reason, the medium P ends up being lifted from an upper surface of the transporting belt 33 in some cases. For example, in a case where the medium P is already lifted, the present gap PG acquired based on the captured image of this lifted medium P has a smaller value than that of the regular gap PG0. In some cases, the present gap PG is larger than the regular gap PG0 when the transporting belt 33 bends toward the lower side.

In Step S33, it is determined that whether or not the medium has come near to the printing head. The controller 50 determines whether or not the present gap PG is less than a threshold PGs. This threshold PGs is set to a value corresponding to the gap slightly before, at which the medium P comes into contact with the nozzle opening surface 16*a* of the printing head 16. In a case where the medium P has come near to the printing head 16 to an extent that the gap PG is less than the threshold PGs, processing proceeds to Step S34, and if the medium P has not come near to the printing head 16 to the extent that gap PG is less than the threshold PGs, processing proceeds to Step S35.

In Step S34, the printing head is driven upward. The controller 50 drives the gap adjusting device 52 in a direction where the printing unit 15 is raised by the electric motor 54 being forward rotation-driven to raise the printing head 16 up to a predetermined height. The printing head 16 retracts above the medium that has come near by this rise of the printing head 16. As a result, scratching led by the medium P, which is lifted and brought near to the printing head 16, coming into contact with the nozzle opening surface 16*a* is avoided. In a case where the present gap PG is less than the threshold PGs and the printing head 16 is retracted upward, printing onto this medium P fails and stops and the medium P is output as it is. Although printing is stopped, the next printing is not affected since defect caused by damage to the nozzle 161 as a result of the medium P scratching the nozzle opening surface 16*a* of the printing head 16 is avoided.

In Step S35, a transported amount F is calculated. The arithmetic unit 85 of the controller 50 calculates the transported amount F through an equation F=F+An. That is, the arithmetic unit 85 acquires the transported amount F from a position at which the leading end of the medium P is detected by adding up all of the per-unit transported amounts An (however, n=1, 2, 3, . . . ) acquired for each unit time after the leading end of the medium P is detected by the image sensor 39.

In Step S36, it is determined that whether or not a discharge position is reached. Herein, the per-unit transported amount An is sufficiently smaller than the pitch of dots defining the printing resolution, and the controller 50 determines whether or not the transported amount F has reached the discharge position at which the inks are discharged. In a case where the discharge position is reached, processing proceeds to Step S37, and if the discharge position is not reached, processing proceeds to Step S42.

In Step S37, it is determined that whether or not the gap is changed. The controller 50 reads the previous gap PG before the unit time from the memory unit, and determines that the gap PG is changed from the fact the current gap PG and the previous gap PG do not coincide with each other. In a case where the gap PG is changed, processing proceeds to Step S38, and if the gap PG is not changed, processing proceeds to Step S41.

In Step S38, it is determined that whether or not the gap is decreased. The controller 50 compares the current gap PG with the previous gap PG, determines that the gap is decreased if the current gap PGn is smaller than the previous gap PGn−1 (PGn<PGn−1), and determines that the gap is increased if the current gap PGn is larger than the previous gap PGn−1 (PGn>PGn−1). In a case where the gap PG is decreased, processing proceeds to Step S39, and if the gap PG is increased, processing proceeds to Step S40 (determined to be negative in S38).

In Step S39, the discharge timing is delayed. In other words, the delay value Dp is increased.

Herein, the head control unit 84 outputs the target transporting velocity Vc and the discharge velocity Vm as parameters that determine the next discharge timing to the correction unit 91. In addition, the arithmetic unit 85 also outputs the calculated medium transporting velocity Vp (=An) and the gap PG to the correction unit 91. The correction unit 91 calculates the delay value Dp through the aforementioned Equation (1), which is $Dp=Ds+\{(PG0-PG)/Vm\}\cdot(Vc-Vp)$, using these parameters Vc, Vm, Vp, and PG. In a case where the gap PG is decreased according to this Equation (1), the delay value Dp increases. This delay value Dp is set by the correction unit 91 in the delay value setting unit 92, and is further set in the delay counter 94 in the printing timing signal generating unit 93 from the delay value setting unit 92.

In Step S40, the discharge timing is hastened. In other words, the delay value Dp is decreased.

The printing control unit 81 outputs these parameters Vc, Vm, Vp, and PG that determine the next discharge timing to the correction unit 91. The correction unit 91 calculates the delay value Dp through the aforementioned Equation (1) using these parameters Vc, Vm, Vp, and PG. In a case where the gap PG is increased according to the Equation (1), the delay value Dp decreases. This delay value Dp is set by the correction unit 91 in the delay value setting unit 92, and is further set in the delay counter 94 of the printing timing signal generating unit 93 from the delay value setting unit 92.

In Step S41, the inks are discharged. The printing control unit 81 outputs a discharge command to the printing timing signal generating unit 93. The printing timing signal generating unit 93 that received this discharge command counts down the delay value Dp by means of the delay counter 94 from a time point at which the pulse of the reference timing signal PRS generated by the input reference pulse signal RS1 being multiplied is input.

Then, the printing timing signal generating unit 93 generates the printing timing signal PTS by the output of the reference timing signal PRS being delayed until the counted value of the delay counter 94 reaches "0 (zero)" and then being output. The generated printing timing signal PTS is output to the head drive circuit 55 via the head controller 51. The head drive circuit 55 causes the ink droplets to be discharged from each nozzle of the printing head 16 by applying one or two drive pulses selected from the drive signal based on the discharge data to each discharge drive element 163 that configures the discharge drive element group 162 at timing when the printing timing signal PTS is input. At this time, the discharged ink droplets land on the target position on the medium P since the discharge timing is corrected according to the gap PG and the medium transporting velocity Vp of that time.

In Step S42, it is determined that whether or not printing is terminated. If printing is not terminated, processing proceeds to Step S32, and each processing of Steps S32 to S42 is repeated until printing is terminated (determined to be affirmative in S42). During printing, since the ink discharge timing of the printing head 16 is corrected according to the gap PG and the medium transporting velocity Vp of each time, the ink droplets discharged from the printing head 16 land on the target position on the medium P. For this reason, an image or the like is printed on the medium P with high print quality. Then, once printing is terminated, processing proceeds to Step S43.

In Step S43, once measuring by the image sensor 39 is terminated and the transporting motor 35 is driven by the rotation amount sufficient to output the medium P after a time point at which printing is terminated, the driving of the transporting motor 35 is stopped and accordingly an transporting operation is terminated.

Hereinafter, the jam avoidance control will be described. First, the measurement processing routine, in which the lift amount LU used in the jam avoidance control (FIG. 19) as the displacement amount of the medium P in the intersecting direction Z is measured, will be described with reference to FIG. 17 and FIG. 18. Herein, in the measurement processing of the lift amount LU, two ways illustrated in FIG. 17 and FIG. 18 are prepared. First of all, the measurement processing routine in which the encoder 37 is not used will be described with reference to FIG. 17. In this measurement processing, the image sensor 38 disposed at a position where a jam is likely to occur is used.

First, in Step S51, it is determined that whether or not the leading end of the medium is detected. This processing is the same as the processing of Step S11 in FIG. 14. The controller 50 stands by until the leading end of the medium P is detected by the image sensor 38, and once the leading end of the medium P is detected, processing proceeds to Step S52.

In Step S52, n is set to 1. That is, the measurement processing is performed for each unit time from the time point at which the leading end of the medium P is detected, and an initial value of n, which is a value indicating the number of times the measurement processing is to be performed, is set (n=1).

In Step S53, the object size value Sn is measured based on the image of the medium acquired by the image sensor. This processing is the same as the processing of measuring the object size value Sn in Step S13 of FIG. 14. In a case where the medium P is displaced in the intersecting direction Z, this object size value Sn increases or decreases in a direction where the displacement has occurred by an amount according to the displacement amount.

This object size value Sn is saved in the memory unit.

In the next Step S54, it is determined that whether or not n is 1. If n is 1, processing proceeds to Step S55, and if n is not 1, that is, at a time of the second and subsequent measurement processing, processing proceeds to Step S56.

In Step S55, an initial lift amount is set. The controller 50 sets the initial lift amount LU to "0 (zero)". Herein, the lift amount LU, which is the displacement amount of the medium P in the intersecting direction Z at a time of n=1 when the leading end of the medium P is detected, is considered to be "0 (zero)", and LU is set to 0.

On the other hand, in Step S56, the changed lift amount ΔLUn is calculated from the current measurement value Sn and the previous measurement value Sn−1. The changed lift amount ΔLUn is calculated through an equation ΔLUn=D (Sn−Sn−1). This changed lift amount ΔLUn is equal to the aforementioned gap changed amount ΔPGn since the changed lift amount ΔLUn indicates the displacement amount of the medium P in the intersecting direction Z (ΔLUn=ΔPGn). Herein, as in the aforementioned description, D denotes the constant of proportionality determined from the slope in the range of use within the graph illustrating the relationship between the imaging distance and the resolution illustrated in FIG. 10.

In Step S57, the present lift amount LU is calculated. That is, the present lift amount LU is calculated through an equation LU=LU+ΔLUn. For example, if n is 2, LU=LU1+ΔLU1 is calculated, and the current changed lift amount ΔLUn is added to the previous lift amount LU. For this reason, for each time, since the current changed lift amount ΔLUn (however, n=1, 2, 3, . . . ) is added to the previous lift amount LU, the lift amount LU is equal to a value obtained by adding the accumulated value of the changed lift amounts ΔLUn (however, n=1, 2, 3, . . . ) to the initial lift amount LU=0. The lift amount LU is saved in the memory unit.

In Step S58, it is determined that whether or not the trailing end of the medium is detected. The controller 50 detects the trailing end of the medium P based on the brightness difference in the image captured by the image sensor 38. If the trailing end of the medium P is not detected, processing returns to Step S53 after an increment of "n" is made (n=n+1) in Step S59. On the other hand, if the trailing end of the medium P is detected, this routine is terminated. Hereinafter, processing of Steps S53 to S59 is repeated until the trailing end of the medium P is detected (determined to be affirmative in S58). As a result, the present lift amount LU is updated for each unit time. Thus, in a period from the detection of the leading end of the medium P by the image sensor 39 to the detection of the trailing end, the lift amount LU of each time is acquired.

Hereinafter, the measurement processing routine in which the encoder 37 is used will be described with reference to FIG. 18.

First, in Step S61, it is determined that whether or not the leading end of the medium is detected. This processing is the same as the processing of Step S11 in FIG. 14. The controller 50 stands by until the leading end of the medium P is detected by the image sensor 38, and once the leading end of the medium P is detected, processing proceeds to Step S62.

In Step S62, n is set to 1. That is, the measurement processing is performed for each unit time from the time point at which the leading end of the medium P is detected, and an initial value of n, which is a value indicating the number of times the measurement processing is to be performed, is set.

In Step S63, the per-unit transported amount An is measured based on a change in the image of the medium acquired by the image sensor. This processing is the same as the processing of measuring the per-unit transported amount An in Step S13 of FIG. 14. In a case where the medium P is displaced in the intersecting direction Z, this per-unit transported amount An increases or decreases with respect to the actual per-unit transported amount of the medium. This per-unit transported amount An is saved in the memory unit.

In the next Step S64, the per-unit transported amount Bn is measured by the encoder. That is, the velocity detecting unit 75 of the controller 50 inputs the reference pulse signal RS1 generated in the same pulse cycle based on the encoder signal ES from the encoder 37 and acquires the per-unit transported amount Bn from the counted value per unit time obtained by counting the pulse edges of this reference pulse signal RS1. This per-unit transported amount Bn is equal to the transport drive velocity, which is the drive velocity of the transport systems including the pair of feeding rollers 42 and the driven roller 43. For example, the per-unit transported amount An (medium transporting velocity Vp) is basically equal to the per-unit transported amount Bn (transport drive velocity Vd) if the medium P does not slide on the pair of feeding rollers 42 and transporting belt 33, the transport drive velocity Vd is the same as the medium transporting velocity Vp, and the imaging distance Zg is kept at a value when the lift amount is 0. On the other hand, if the sliding of the medium P on the pair of feeding rollers 42 and the transporting belt 33 can be neglected, it can be considered that the transport drive velocity Vd and the medium transporting velocity Vp are the same, and if the medium P is lifted in this state and the imaging distance Zg changes, the per-unit transported amount An (medium transporting velocity Vp) becomes basically inconsistent with the per-unit transported amount Bn (transport drive velocity Vd). In other words, it can be considered that the inconsistency between the per-unit transported amount An and the per-unit transported amount Bn is due to the change in the imaging distance, that is, the lifting of the medium P. This per-unit transported amount Bn is saved in the memory unit. As for the pair of feeding rollers 42, the per-unit transported amount Bn may be acquired from the counted value per unit time obtained by counting the pulse edges of an encoder signal input from a rotary encoder (an example of the encoder) (not illustrated) that detects the rotation of these drive rollers.

In Step S65, the present lift amount LU is calculated. That is, the present lift amount LU is calculated through an equation LU=K(Bn−An). Herein, K denotes the constant of proportionality determined from the slope in the range of use within the graph illustrating the relationship between the imaging distance and the resolution illustrated in FIG. 10. The calculated lift amount LU is saved in the memory unit.

In Step S66, it is determined that whether or not the trailing end of the medium is detected. The controller 50 detects the trailing end of the medium based on the brightness difference in the image captured by the image sensor 38. If the trailing end of the medium is not detected, processing returns to Step S63 after an increment of "n" is made (n=n+1) in Step S67. On the other hand, if the trailing end of the medium is detected, this routine is terminated. Hereinafter, processing of Steps S63 to S67 is repeated until the trailing end of the medium is detected (determined to be affirmative in S66). As a result, the present lift amount LU saved in the memory unit is updated for each unit time. Thus, in a period from the detection of the leading end of the medium P by the image sensor 39 to the detection of the trailing end, the lift amount LU of each time is acquired.

Hereinafter, the jam avoidance control routine in which the lift amount LU obtained in the measurement processing of FIG. 17 or FIG. 18 will be described with reference to FIG. 19. In this jam avoidance control, the driving of the transporting motor 35 is stopped so as to avoid beforehand, for example, the occurrence of the jam caused by the medium P, of which a leading end portion is lifted, without being nipped by the pair of feeding rollers 42 or the driven roller 43. In other words, once it is detected that the medium P is lifted to an extent of causing the jam, the occurrence of the jam is avoided by stopping the driving of the transporting motor 35. In addition, when the lifting of the medium P is detected at an initial stage of the jam occurrence at a position near to the pair of feeding rollers 42 or the driven roller 43, the driving of the transporting motor 35 is stopped in order to stop the transporting operation at an early stage from the jam occurrence. In other words, once the lifting of the medium P is detected at the initial stage of the jam occurrence, intensifying the jam is avoided by the driving of the transporting motor 35 being stopped.

First, in Step S71, transporting of the medium is initiated. That is, the controller 50 drives the transporting motor 35 to feed the medium P from the cassette 12*c* or the feeding tray 12F. The fed medium P is fed and transported toward a printing initiation position on a path through which the pair of feeding rollers 42 and the driven roller 43 pass. For example, during transporting of the medium P, the skew (oblique movement) of the medium P is eliminated by the leading end of the medium P being struck by the pair of stopped feeding rollers 42.

Then, by the driving of the pair of feeding rollers 42 is initiated after the skew removal, the medium P after the skew removal is transported toward the printing initiation position, is passed on to the transporting belt 33 of the transporting mechanism 30 through the pair of feeding rollers 42 and the driven roller 43, and is transported in a state of being electrostatically adsorbed onto the rotating transporting belt 33.

In the next Step S72, the measurement processing is executed to acquire the lift amount LU. This measurement processing is performed by the measurement processing routine illustrated in the aforementioned FIG. 17 or FIG. 18 being executed. As a result of this measurement processing, the present lift amount LU is acquired based on the image of the medium P imaged by the image sensor 38. For example, in a case where a leading end portion of the medium P is lifted due to the curling of the medium P or the like, the present lift amount LU acquired based on the captured image of this lifted medium P is a positive value.

In the next Step S73, it is determined that whether or not the lift amount LU exceeds a threshold Us. The controller 50 determines whether or not the present lift amount LU exceeds the threshold Us. This threshold Us is set to a value corresponding to the lift amount at which a jam might occur by the medium P not being nipped by the pair of feeding rollers 42 or the driven roller 43 or to a value corresponding to the lift amount at the initial stage of the jam occurrence. In a case where the medium P is not lifted to an extent of causing the threshold Us to be exceeded (LU≤Us), processing proceeds to Step S74, and in a case where the medium P is lifted to an extent of causing the threshold Us to be exceeded (LU>Us), processing proceeds to Step S76.

In Step S74, it is determined that whether or not printing is terminated. If printing is not terminated, processing returns to Step S72, each processing of Steps S72 to S74 is repeated until printing is terminated (determined to be affirmative in S74). For example, in a case where the medium P is lifted to the extent of causing the jam, or in a case where the jam is occurred for some reason and the medium P is lifted to a position of the initial stage of the jam occurrence, processing transitions to Step S75 since this lift amount LU exceeds the threshold Us (LU>Us) (determined to be affirmative in S73).

In Step S75, printing is stopped and measurement by the image sensor is stopped. That is, the controller 50 stops the driving of the transporting motor 35, and also stops the driving of the printing head 16 if printing performed by discharging the ink droplets onto the medium P is already initiated at that time. As a result, the occurrence of the jam can be prevented beforehand and the jam can be stopped at the initial stage of the occurrence. For example, if the stop of the driving of the transporting motor 35 is delayed when the jam is occurred, the jam is intensified and thus the work of eliminating the medium P becomes complicated. In addition, the medium P that led to the occurrence of the jam might go deep in between the pair of feeding rollers 42 or between the transporting belt 33 and the driven roller 43 and impair the outer surface of the roller, the outer surface of the transporting belt 33, and the like. On the contrary, in this embodiment, since the transporting operation is stopped right after the initial stage of the jam occurrence, the jammed medium P can be eliminated relatively easily and impairing the pair of feeding rollers 42, or the outer surfaces of the transporting belt 33, the driven roller 43, and the like by the jammed medium P can be avoided.

On the other hand, in a case where printing is terminated without the lift amount LU exceeding the threshold Us in Step S73 (determined to be affirmative in S74), processing proceeds to Step S76.

In Step S76, once the measurement by the image sensor 38 is terminated and the transporting motor 35 is driven by the rotation amount sufficient to output the medium P, the driving of the transporting motor 35 is stopped and accordingly the transporting operation is terminated.

According to the first embodiment described in detail hereinbefore, the following effects can be obtained.

(1) The printing apparatus 11 is provided with the printing unit 15 that prints onto the medium P and the image sensors 38 and 39 that image the medium P. The controller 50 detects the displacement amount of the medium P in the intersecting direction Z that intersects the surface to be printed Pa of the medium P based on the plurality of images obtained by the image sensors 38 and 39 imaging the medium P at different times and controls the transporting device 14 and the printing unit 15 according to this displacement amount. Accordingly, for example, printing defect attributable to the lifting of the medium P can be restricted or alleviated. For example, a deviation of the printing position from the target position with respect to the medium P, the scratching of printing head 16 by medium P and the medium P jam can be restricted or alleviated.

(2) The velocity detecting unit 75 that detects the drive velocity Vd (an example of the transporting velocity) of the transporting belt 33 which configures the transporting device 14 transporting the medium P is provided. The controller 50 acquires the displacement amount of the medium P in the intersecting direction Z based on the per-unit transported amount An (medium transporting velocity Vp), which is based on the plurality of images obtained by the image sensors 38 and 39 imaging the medium P at different times, and the transported amount Bn (transport drive velocity Vd) detected by the velocity detecting unit 75. Accordingly, the displacement amount of the medium P in the intersecting direction Z can be acquired using the image sensors 38 and 39 and the velocity detecting unit 75.

(3) The encoder 37 capable of detecting the drive amount of the transporting device 14 is further provided. The velocity detecting unit 75 acquires the second transport velocity based on the output signal of the encoder 37. Accordingly, the displacement amount of the medium P in the intersecting direction Z can be acquired based on the per-unit transported amount An (an example of the first transport velocity), which is based on the plurality of images obtained by the image sensors 38 and 39 imaging the medium P at different times, and per-unit transported amount Bn (an example of the second transport velocity) of the medium P, which is based on the output signal of the encoder 37. For this reason, the displacement amount of the medium P in the intersecting direction Z can be acquired using the encoder 37 and the image sensors 38 and 39.

(4) The controller 50 displaces the medium P in a direction of approaching the image sensors 38 and 39 if the medium transporting velocity Vp (an example of the first transport velocity) is higher than the transport drive velocity Vd (an example of the second transport velocity), and displaces the medium P in a direction of going further away from the image sensors 38 and 39 if the medium transporting velocity Vp is lower than the transport drive velocity Vd. Accordingly, the printing head 16 can be controlled according to the direction in which the medium P is displaced in the intersecting direction Z.

(5) The controller 50 acquires the object OJ that is focused on in an image ID obtained by the image sensors 38 and 39 imaging the medium P for each unit time and acquires the displacement amount of the medium P in the intersecting direction Z based on the difference in the per-unit transported amount An, which is the movement amount of the object OJ per unit time, or the difference in object size value Sn per unit time. Accordingly, the displacement amount of the medium P in the intersecting direction Z can be acquired even if the transport drive velocity Vd (an example of the second transport velocity) detected by the velocity detecting unit 75 is not used. For example, the disuse of the velocity detecting unit 75 is possible.

(6) The controller 50 acquires the object size value Sn of the object OJ in the image ID obtained by the image sensors 38 and 39 imaging the medium P for each unit time and acquires the displacement amount of the medium P in the intersecting direction Z based on the difference between the object size value Sn−1 of the object OJ in the previous image and the object size value Sn of the object OJ in the current image. Accordingly, the displacement amount of the medium P in the intersecting direction Z can be acquired even if the transport drive velocity Vd (an example of the second transport velocity) detected by the velocity detecting unit 75 is not used.

(7) The controller 50 increases the lifted amount LU (an example of the displacement amount) of the medium P in the direction of approaching the printing head 16 as the current object size value Sn of the object OJ becomes larger than the previous object size value Sn−1 of the object OJ. Accordingly, the lifted amount of the medium P can be detected based on the image ID obtained by imaging the medium P. Even if the sliding of the medium P with respect to the transporting belt 33 of the transporting device 14, the pair of feeding rollers 42, and the driven roller 43 or the change in the drive velocity Vd of the transporting device 14 occurs, the displacement amount of the medium P in the intersecting direction Z can be acquired without being affected by these factors.

(8) The controller 50 acquires the per-unit displacement amounts (ΔPGn and ΔLUn) based on the difference between the previous object size value Sn−1 and the current object size value Sn and adds up the per-unit displacement amounts to acquire the displacement amount of the medium in the intersecting direction Z. Accordingly, even if the sliding of the medium P with respect to the transporting belt 33 of the transporting device 14, the pair of feeding rollers 42, and the driven roller 43 or the change in the drive velocity Vd of the transporting device 14 occurs, the displacement amount (ΔPG) of the medium P in the intersecting direction Z can be acquired without being affected by these factors.

(9) The controller 50 acquires the gap PG between the printing head 16 and the medium P can be acquired according to the displacement amount. Accordingly, the printing head 16 can be controlled according to the gap PG.

(10) The image sensors 38 and 39 disposed at positions where the unprinted area of the medium P before being printed by the printing head 16 can be imaged in the relative movement direction of the printing unit 15 and the medium P. The controller 50 controls the discharge timing of the printing head 16 of the liquid discharging system that prints onto the medium P by the ink, which is an example of the liquid, being discharged according to the gap PG. Accordingly, even if the gap PG changes by the medium P being displaced in the intersecting direction Z, an increase in the deviation of the landing position of the inks with respect to the medium P can be curbed. As a result, an appropriate printing can be carried out on the medium P.

(11) The controller 50 stops the driving of the transporting motor 35, which is a power source of the transporting device 14, once the lift amount LU, which is an example of the displacement amount, exceeds the threshold Us. For example, once the jam occurs and the lift amount LU of the medium P in the intersecting direction Z exceeds the threshold Us, the driving of the transporting unit is stopped. As a result, after the jam occurrence, the jam can be alleviated by the driving of the transporting unit being stopped relatively early.

(12) The controller 50 controls the gap adjusting device 52 that adjusts the gap between the printing head 16 and the medium P according to the displacement amount. The scratching of the nozzle opening surface 16*a* of the printing head 16 by the lifted medium P can be avoided. For example, there are concerns over the destruction of an ink meniscus inside the nozzle 161 or the occurrence of an ink discharge defect due to paper dust being mixed in the nozzle 161 if the medium P scratches the nozzle opening surface 16*a*. However, the occurrence of the ink discharge defect attributable to the scratching of the nozzle opening surface 16*a* by the medium P can be avoided since the printing unit 15 is raised and the printing head 16 is retracted upward once the medium P is lifted to the extent that the threshold PGs is exceeded.

(13) The printing method in which the printing unit 15 prints onto the medium P includes detection steps (Step S32 of FIG. 14, FIG. 15, and FIG. 16, and Step S72 of FIG. 17, FIG. 18, and FIG. 19) of detecting the displacement amount of the medium P in a direction which intersects the surface to be printed Pa of the medium P based on the plurality of images obtained by imaging the medium P at different times. In addition, the printing method includes control steps (Steps S33 and S34 and Steps S36 to S41 of FIG. 16 and Steps S73 and S75 of FIG. 19) of controlling at least the printing head 16 based on the displacement amount. According to this method, the same effect as the aforementioned effect (1) can be achieved.

(14) In a case where the image sensor 39 is disposed at a position opposing the printing head 16 with the transporting path of the medium P being interposed therebetween, the image sensor 39 can be protected by the medium P from the inks discharged from the printing head 16. In particular, by the transporting mechanism 30 being configured as the belt transporting mechanism 30A provided with the plurality of transporting belts 33 that transport the medium P and by the image sensor 39 being disposed in the clearance OP between the plurality of transporting belts 33, the back surface of the medium P is imaged by the image sensor 39 from the clearance OP. Accordingly, the inks are unlikely to adhere to the image sensor 39, and thus a decline in the detection accuracy of the image sensor 39 attributable to the adhesion of the inks can be restricted.

(15) In a case where the image sensor 39 is attached to the transporting mechanism 30 capable of moving between the transporting position and the retract position, the image sensor 39 retracts, along with the transporting mechanism 30, from a discharge target area of the printing head 16 at a time of cleaning. For this reason, the inks discharged from the printing head 16 are restricted from adhering to the image sensor 39 at a time of cleaning. Accordingly, a decline in the detection accuracy of the image sensor 39 attributable to the adhesion of the inks is restricted.

Second Embodiment

Hereinafter, a second embodiment will be described with reference to FIG. 20 and FIG. 21. In this embodiment, the printing apparatus 11 is an example of a serial printer. A difference is that the printing unit 15 in FIG. 1 of the first embodiment is replaced with a serial printing system. Description on the same configuration as that of the first embodiment will not be repeated, and only differences will be described in particular.

Figure 20:
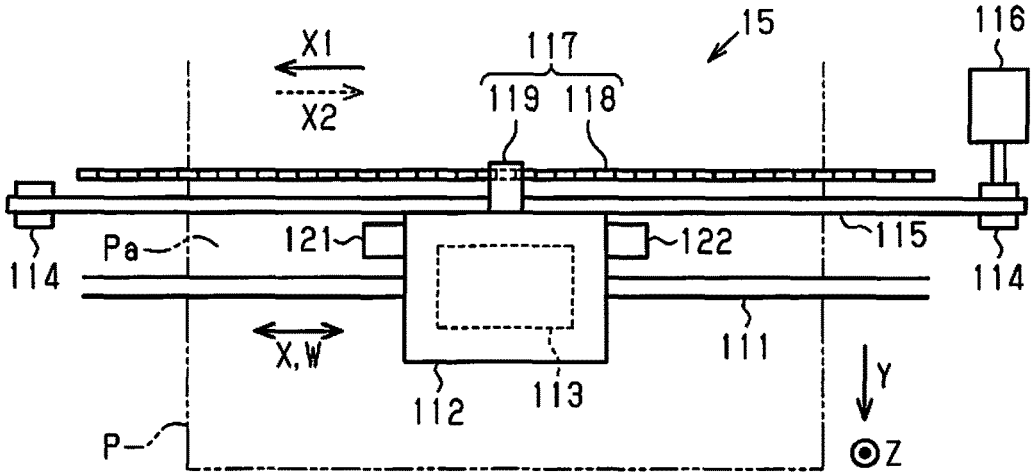
FIG. 20 is a schematic plan view illustrating a periphery of a printing unit of a printing apparatus in a second embodiment.

As illustrated in FIG. 20, the printing unit 15, which is an example of the printing unit is provided with a carriage 112 capable of moving in a scanning direction X (the same as the width direction W) by being guided by a guide member 111 that extends in the width direction W which intersects the transporting direction Y of the medium P and a printing head 113 provided on a lower side of the carriage 112. An endless belt 115 is wound around a pair of pulleys 114 disposed on both sides at a predetermined distance which is slightly longer than a moving area of the carriage in the scanning direction X, and the carriage 112 is fixed to a part of the belt 115. One pulley 114 is connected to an output shaft of a carriage motor 116. The carriage 112 is capable of reciprocating in the scanning direction X by the carriage motor 116 being forward rotation- or reverse rotation-driven and the belt 115 being rotated forward or rotated reversely. A linear encoder 117, which is an example of the encoder, is provided on a rear surface side of the carriage 112. The linear encoder 117 is provided with a linear scale 118 stretched along a movement path of the carriage 112 and a sensor 119 fixed to a rear surface portion of the carriage 112 in a state of being capable of reading the linear scale 118. The sensor 119 outputs an encoder pulse signal that includes pulses to the controller 50, and the number of pulses is proportional to the moving distance of the carriage 112. By the number of pulse edges of the encoder pulse signal input from the linear encoder 117 being counted by a counter (not illustrated), the controller 50 acquires a position (carriage position) of the carriage 112 in the scanning direction X from this counted value.

Figure 21:
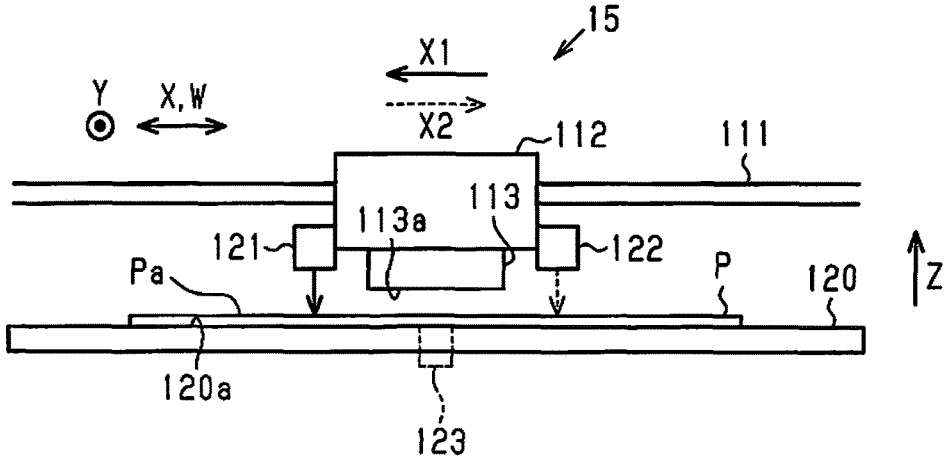
FIG. 21 is a schematic front view illustrating the same periphery of the printing unit.

As illustrated in FIG. 21, a supporting base 120 that extends in the scanning direction X is disposed at a position opposing the lower side with respect to the movement path of the carriage 112. By the transported medium P being supported by a support surface 120*a*, which is an upper surface of the supporting base 120, the gap PG between a nozzle opening surface 113*a* of the printing head 113 and the medium P is maintained constant. The printing apparatus 11 is provided with a gap adjusting device (not illustrated) capable of moving the carriage 112 in a direction (intersecting direction Z) of coming near to or being spaced away from the support surface 120*a* of the supporting base 120 is possible. The gap PG is adjusted by this gap adjusting device so as to be the gap PG0 determined according to the medium type (for example, sheet type). However, once the medium P is lifted from the support surface 120*a* in a direction that intersects the surface to be printed, the gap PG changes so as to be smaller than the gap PG0 when the lifted amount is "0 (zero)".

As illustrated in FIG. 20 and FIG. 21, a pair of image sensors 121 and 122 capable of imaging the medium P on both sides of the scanning direction X is attached to the carriage 112. The image sensors 121 and 122 are disposed at positions where the unprinted area of the medium P before being printed by the printing head 16 can be imaged in a relative movement direction (scanning direction X) between the carriage 112 and the medium P. An image of the medium P imaged by one image sensor positioned on a front side in the travelling direction of the carriage 112 out of the pair of the image sensors 121 and 122 is used when the controller 50 executes each routine illustrated in FIG. 14 to FIG. 16. That is, when the carriage 112 moves in a departing direction X1 in FIG. 20 and FIG. 21, an image of the medium P imaged by the first image sensor 121 positioned on the front side (left in FIG. 20 and FIG. 21) in the travelling direction at that time is used. On the other hand, when the carriage 112 moves in a returning direction X2 in FIG. 20 and FIG. 21, an image of the medium P imaged by a second image sensor 122 positioned on the front side (right in FIG. 20 and FIG. 21) in the travelling direction at that time is used.

In the controller 50, the printing timing signal PTS is generated based on the present gap PG, the medium transporting velocity Vp, and the like, all of which are acquired based on the image captured by the image sensor on the front side in the travelling direction. For this reason, even if the medium P is lifted more or less, the ink droplets land at the target position on the medium P and dots are formed at appropriate positions since the discharge timing of the printing head 113 is corrected.

In addition, in a case where the detected lift amount LU exceeds the threshold Us (LU>Us), the scratching of the nozzle opening surface 113*a* by the lifted medium P is avoided by the controller 50 driving the gap adjusting device (not illustrated) to raise the printing head 113 along with the carriage 112.

As illustrated in FIG. 21, an image sensor 123 may be provided on a supporting base 120 side.

In an example of FIG. 21, the image sensor 123 is buried at a position on an upstream side of the most upstream nozzle of the printing head 113 in the transporting direction Y so as to be capable of imaging the medium P from the back surface side. This image sensor 123 outputs the captured image of the back surface of the medium P to the controller 50 and the controller 50 detects the lifting of the medium P from the support surface 120*a* based on this image. Then, once the lift amount LU exceeds the threshold Us, the controller 50 drives the gap adjusting device (not illustrated) to raise the printing head 113 along with the carriage 112. Accordingly, the scratching of the nozzle opening surface 113*a* of the printing head 113 by the medium P can be avoided.

The same image sensor 38 as that of the first embodiment is provided on the upstream side of the movement path of the carriage 112 in the transporting direction Y, and once the lift amount LU of the medium P detected based on the image captured by the image sensor 38 exceeds the threshold Us, the occurrence of the medium P jam is avoided by the controller 50 stopping the driving of the transporting motor.

Even if the printing apparatus 11 is such a serial type, the same or the same types of effects as the effects (1) to (14) of the first embodiment can be achieved, and the following effects are further achieved.

(15) The printing unit 15 is capable of moving in the width direction W that intersects the transporting direction Y of the medium P, and the pair of image sensors 121 and 122 are provided on the both sides of the carriage 112 in the moving direction (scanning direction X). The controller 50 controls the discharge timing of the printing head 113 based on the gap PG according to the displacement amount which is acquired based on the image captured by one image sensor disposed on a leading side of the carriage 112 in the moving direction out of the pair of the image sensors 121 and 122. Accordingly, the gap PG can be detected relatively accurately based on the image of the unprinted area of the medium P to be printed from now on imaged by the image sensors 121 and 122. By the inks being discharged at the appropriate discharge timing according to this detected gap PG, an appropriate printing can be carried out on the medium P. In addition, as in the first embodiment, the controller 50 can perform the jam avoidance control, the head scratching avoidance control in addition to a discharge timing control.

The above embodiments can be changed into the following forms.

At least one of the transporting mechanism 30 and the printing head 16 may be controlled according to the displacement amount. For example, only the discharge timing correction of the printing head 16 may be performed. In addition, only the jam avoidance control may be performed. Only the head scratching avoidance control may be performed. In addition, two of the discharge timing correction and the jam avoidance control may be performed, two of the discharge timing correction and the head scratching avoidance control may be performed, or two of the jam avoidance control and the head scratching avoidance control may be performed. In addition, controller 50 may control the gap adjusting device so as to move the printing unit 15 in the intersecting direction such that the obtained gap PG approaches the regular gap PG0.

Instead of the size (object size value Sn) of the object OJ, the displacement amount of the medium P may be acquired using the per-unit transported amount An. In a case where the transporting velocity determined from the printing mode may be considered to be constant, the per-unit transported amount An (medium transporting velocity) may be acquired by the image sensor and the gap changed amount (=D(An−A0)) may be acquired based on a difference between this per-unit transported amount An and a known per-unit transported amount A0 (regular medium transporting velocity) at a time of the regular gap PG0 according to the printing mode of that time. At this time, in a case where the medium is imaged by the image sensor from the same side of the printing head, it is determined that the medium P goes further away from the printing head 16 if the per-unit transported amount An is smaller than the reference per-unit transported amount A0, and, on the contrary, the medium P approaches the printing head 16 if the per-unit transported amount An is larger than the reference per-unit transported amount A0. In addition, the gap PG is calculated through an equation PG=PG0+D(An−A0), and at least one of the discharge timing correction and the head scratching avoidance control may be performed according to the gap PG.

The object may be a mark made in the margin outside the printing region of the medium, and the displacement amount of the medium in the intersecting direction may be acquired based on the plurality of images of the mark imaged at different times.

In addition, without being limited to a printed mark, the mark may be a small hole pierced by a needle or a small recessed portion (crack) formed at a regular pitch by pushing sharp teeth of, for example, a serrated roller toward the medium.

Without being to the rotary encoder that detects the rotation of the roller, the encoder may be a linear encoder that detects, by means of a sensor including a magnetic sensor, a linear scale, including a magnetic scale, formed over the entire periphery of the peripheral portion of the transporting belt.

A position at which the image sensor used for the discharge timing correction is disposed may be on the downstream side of the most upstream nozzle of the printing head. If the printed surface can also be tracked as the object, the displacement amount of the medium in the intersecting direction Z can be detected.

In the first embodiment, a plurality of image sensors 39 may be provided in the width direction W. In this case, each printing head 16 may separately undergo the discharge timing correction according to each displacement amount obtained by each image sensor 39.

A pair of image sensors 38 may be provided at different positions in the transporting direction to determine the presence or absence of the jam occurrence based on each difference between displacement amounts obtained by the pair of image sensors 38.

The image sensor for jam avoidance control may be at a position on the upstream side of a pair of output rollers disposed on the downstream side of the printing head in the transporting direction.

The image sensor for discharge timing correction and the image sensor for head scratching avoidance control may be separately provided.

The velocity detecting unit may detect the second transport velocity at which the medium P is transported by the transporting unit based on the image obtained by the image sensor imaging the outer surface of the transporting belt 33 or the outer peripheral surface of the roller 31 on the drive side of the belt transporting mechanism 30A at different times. In addition, in a case of a configuration where the transporting unit is provided with the pair of transporting rollers positioned on both sides in the transporting direction Y with the supporting base being interposed therebetween, the outer peripheral surface of a rotation shaft of the drive roller that configures the pair of transporting rollers may be imaged by the image sensor and the second transport velocity at which the medium P is transported by the transporting unit may be detected based on the plurality of images obtained by the image sensor imaging the rotation shaft at different times.

The velocity detecting unit may be disused. For example, the power source (transporting motor 35) of the transporting unit may be feedforward-controlled.

In a case where the printing apparatus is the ink jet system (liquid discharging system), the ink, which is an example of the discharged liquid, may be various types of liquid composition including a gel ink and a hot melt ink as well as a general aqueous ink and oil-based ink. In addition, the ink may be a clear ink for coating.

In addition, the printing apparatus may print onto the medium by discharging liquids other than the ink.

Without being limited to a line type printer or a serial type printer, the printing apparatus may be a lateral type printer that prints onto the medium by moving the carriage in two directions, for example, one being a main scanning direction and the other being a sub-scanning direction, with respect to the medium P transported to the printing position by the transporting unit.

In addition to the ink jet system, the printing apparatus may be a dot impact type or an electrophotographic type printer. In addition, without being limited to a printing dedicated device, the printing apparatus may be a multi-function printer provided with a scanner device having a copy function and a scanner function. In this case, in the scanner device, the jam avoidance control may be performed by the image sensor 38 being disposed on the upstream side of the pair of transporting rollers in the transporting direction.

Each functional unit constructed in the printing control unit 81 of the controller 50 may be realized as software by a computer executing a program, may be realized as hardware by an electronic circuit including a field-programmable gate array (FPGA) or an application specific IC (ASIC), or may be realized by the cooperation of the software and the hardware.

Without being limited to the sheet, the medium a medium including a resin film or sheet, a film (laminate film) made of a composite of a resin and a metal, a fabric, a nonwoven fabric, metal foil, a metal film, and a ceramic sheet. In addition, without being limited to a flat-shaped medium including paper and the sheet, the medium may be a three-dimensional object having a predetermined shape including a cylinder, a cone, and a polygonal pyramid.

Without being limited to the printing apparatus that prints onto the flat-shaped medium including the paper, the printing apparatus may be, for example, a printing apparatus for forming three-dimensional object that forms a three-dimensional object by discharging resin droplets in the ink jet system. In this case, the medium may be a mount- or sheet-shaped substrate, which is a target to which the resin droplets are discharged. By performing the discharge timing correction according to the gap even in this type of printing apparatus for forming three-dimensional object, the accuracy of forming the three-dimensional object can be enhanced. In addition, if the head scratching avoidance control is performed, the scratching of the printing head by the medium can be avoided, and if the jam avoidance control is performed, the jam can be avoided or alleviated.

The entire disclosure of Japanese Patent Application No.: 2016-022786, filed Feb. 9, 2016 is expressly incorporated by reference herein.

What is claimed is:

1. A printing apparatus comprising:

a transporting unit that transports a medium and that includes a medium support surface supporting the medium;

a printing unit that prints onto the medium;

a sensor that images the medium; and a control unit that detects a displacement amount of the medium, which is an amount the medium is lifted from the medium support surface in an intersecting direction which extends along a thickness direction of the medium, based on a transport velocity which is acquired based on a plurality of images obtained by imaging the medium by the sensor at different times and that controls at least one of the transporting unit and the printing unit according to the displacement amount.

2. The printing apparatus according to claim 1, wherein the transporting unit includes a velocity detecting unit that detects a transport drive velocity at which the medium is transported by the transporting unit, and the control unit acquires the displacement amount based on a first transport velocity, which is acquired based on the plurality of images obtained by imaging the medium by the sensor at different times, and a second transport velocity, which is the transport drive velocity detected by the velocity detecting unit.

3. The printing apparatus according to claim 2, further comprising:

an encoder that is capable of detecting a drive amount of the transporting unit, wherein the velocity detecting unit acquires the second transport velocity based on an output signal of the encoder.

4. The printing apparatus according to claim 2, wherein the control unit displaces the medium in a direction of approaching the sensor if the first transport velocity is higher than the second transport velocity and displaces the medium in a direction of going further away from the sensor if the first transport velocity is lower than the second transport velocity.

5. The printing apparatus according to claim 1, wherein the control unit acquires the displacement amount based on a difference in sizes per unit time or a difference in movement amounts per unit time of an object that is focused on in an image obtained by imaging the medium by the sensor for each unit time.

6. The printing apparatus according to claim 5, wherein the control unit acquires the difference in sizes per unit time using a previous size of the object in a previous image obtained by imaging the medium by the sensor for each unit time and a current size of the object in a current image and acquires the displacement amount based on the difference in sizes per unit time.

7. The printing apparatus according to claim 6, wherein the control unit increases the displacement amount of the medium in a direction of approaching the printing unit as the current size of the object becomes larger than the previous size of the object.

8. The printing apparatus according to claim 6, wherein the control unit acquires a per-unit displacement amount, which is a displacement amount of the medium in the intersecting direction per unit time based on a difference between the previous size of the object and the current size of the object and acquires the displacement amount of the medium in the intersecting direction by adding up the per-unit displacement amount.

9. The printing apparatus according to claim 1, wherein the control unit acquires a gap between the printing unit and the medium according to the displacement amount.

10. The printing apparatus according to claim 9, wherein the sensor is disposed at a position where an unprinted area of the medium can be imaged on an upstream side of the printing unit in a transporting direction of the medium, the printing unit is a liquid discharging system that discharges a liquid onto the medium to print, and the control unit corrects discharge timing of the printing unit according to the gap.

11. The printing apparatus according to claim 9, wherein the printing unit is capable of moving in a width direction that intersects a transporting direction of the medium, the sensor is provided as a pair at portions on both sides of the printing unit in a moving direction, and the control unit corrects discharge timing of the printing unit based on the gap, which is acquired based on an image captured by one sensor disposed on a portion of the printing unit on a leading side in the moving direction out of the pair of sensors.

12. The printing apparatus according to claim 1, wherein the control unit stops driving of the transporting unit once a threshold of the displacement amount is exceeded.

13. The printing apparatus according to claim 1, further comprising:

a gap adjusting unit that adjusts a gap between the printing unit and the medium, wherein the control unit controls the gap adjusting unit according to the displacement amount.

14. A printing method for a printing unit that prints onto a medium transported by a transporting unit that includes a medium support surface supporting the medium, the printing method comprising:

detecting a displacement amount of the medium, which is an amount the medium is lifted from the medium support surface in an intersecting direction which extends along a thickness direction of the medium, based on a transport velocity which is acquired based on a plurality of images obtained by imaging the medium at different times; and controlling at least one of the transporting unit and the printing unit based on the displacement amount.

15. A printing apparatus comprising:

a transporting unit that transports a medium;

a printing unit that prints onto the medium;

a sensor that images the medium; and a control unit that detects a displacement amount of the medium in an intersecting direction which intersects a surface to be printed of the medium based on a plurality of images obtained by imaging the medium by the sensor at different times and that controls at least one of the transporting unit and the printing unit according to the displacement amount, wherein the transporting unit includes a velocity detecting unit that detects a transport drive velocity at which the medium is transported by the transporting unit, and the control unit acquires the displacement amount based on a first transport velocity, which is acquired based on the plurality of images obtained by imaging the medium by the sensor at different times, and a second transport velocity, which is the transport drive velocity detected by the velocity detecting unit.

16. A medium processing apparatus comprising:

a transporting unit that transports a medium including a medium support surface supporting the medium;

a printing unit that prints onto the medium;

a sensor that images the medium; and a control unit that detects a displacement amount of the medium, which is an amount the medium is lifted from the medium support surface in an intersecting direction which extends along a thickness direction of the medium, based on a transport velocity which is acquired based on a plurality of images obtained by imaging the medium by the sensor at different times and that controls at least one of the transporting unit and the printing unit according to the displacement amount.

17. A medium processing apparatus comprising:

a transporting unit that transports a medium;

a printing unit that prints onto the medium;

a sensor that images the medium; and a control unit that detects a displacement amount of the medium in an intersecting direction which intersects a surface to be printed of the medium based on a plurality of images obtained by imaging the medium by the sensor at different times and that controls at least one of the transporting unit and the printing unit according to the displacement amount, wherein the transporting unit includes a velocity detecting unit that detects a transport drive velocity at which the medium is transported by the transporting unit, and the control unit acquires the displacement amount based on a first transport velocity, which is acquired based on the plurality of images obtained by imaging the medium by the sensor at different times, and a second transport velocity, which is the transport drive velocity detected by the velocity detecting unit.

* * * * *